US005885764A

United States Patent [19]

Kobayashi et al.

[11] Patent Number: 5,885,764

[45] Date of Patent: Mar. 23, 1999

[54] METHINE COMPOUND AND SILVER HALIDE PHOTOGRAPHIC LIGHT-SENSITIVE MATERIAL CONTAINING THE COMPOUND

[75] Inventors: Katsumi Kobayashi; Takanori Hioki; Takeshi Suzumoto, all of Kanagawa, Japan

[73] Assignee: Fuji Photo Film Co., Ltd., Kanagawa, Japan

[21] Appl. No.: 941,540

[22] Filed: Sep. 30, 1997

[30] Foreign Application Priority Data

Oct. 4, 1996 [JP] Japan ..... 8-264140

[51] Int. Cl.[6] ..... G03C 1/12

[52] U.S. Cl. ..... 430/584; 430/581; 430/583; 430/585; 430/588; 430/591

[58] Field of Search ..... 430/581, 584, 430/585, 583, 588, 591

[56] References Cited

U.S. PATENT DOCUMENTS 3,622,316 11/1971 Bird et al. .
4,717,650 1/1988 Ikeda et al. ..... 430/584

OTHER PUBLICATIONS

CA: 95:117049, 1981.

*Primary Examiner*—Thorl Chea
*Attorney, Agent, or Firm*—Sughrue, Mion, Zinn, Macpeak & Seas, PLLC

[57] ABSTRACT

A silver halide photographic light-sensitive material is disclosed containing at least one methine compound represented by formula (I) or (III). Further disclosed is the methine compound represented by formula (I).

5 Claims, No Drawings

METHINE COMPOUND AND SILVER HALIDE PHOTOGRAPHIC LIGHT-SENSITIVE MATERIAL CONTAINING THE COMPOUND

FIELD OF THE INVENTION

The present invention relates to a highly sensitive silver halide photographic light-sensitive material having a high percent of light absorption, and it also relates to a novel compound.

BACKGROUND OF THE INVENTION

A great deal of effort has been hitherto made to achieve high sensitivity of silver halide photographic light-sensitive materials. With regard to sensitizing dyes, it is considered that if the percent of light absorption is increased, the transmission efficiency of light energy to silver halide is improved and thereby high spectral sensitivity can be achieved.

However, the amount of the sensitizing dye adsorbed onto the surface of a silver halide grain is limited and adsorption of the sensitizing dye in excess of the single layer saturated adsorption is difficult to achieve. Accordingly, individual silver halide grains have a very low percent of absorption in terms of the quantum of incident light in the spectral sensitization region.

To solve these problems, the following methods have been proposed.

In P. B. Gilman, Jr. et al, *Photographic Science and Engineering*, Vol. 20, No. 3, page 97 (1976), a cation dye is adsorbed to the first layer and an anion dye is adsorbed to the second layer using the electrostatic force.

In U.S. Pat. No. 3,622,316, G. B. Bird et al describe a technique in which a plurality of dyes in multiple layers are adsorbed to silver halide and the Forster-type excitation energy transfer contributes to the sensitization.

In JP-A-63-138341 (the term "JP-A" as used herein means an "unexamined published Japanese patent publication") and JP-A-64-84244, Sugimoto et al describe a technique of performing the spectral sensitization by the energy transfer from a luminescent dye.

In R. Steiger et al, *Photographic Science and Engineering*, Vol. 27, No. 2, page 59 (1983), the spectral sensitization is performed by the energy transfer from a gelatin-substituted cyanine dye.

In JP-A-61-251842, Ikegawa et al describe a technique of performing the spectral sensitization by the energy transfer from a cyclodextrin-substituted dye.

With respect to the so-called link dye having two separate chromophores which are not conjugated but linked through a covalent bond, examples thereof are described in U.S. Pat. Nos. 2,393,351, 2,425,772, 2,518,732, 2,521,944 and 2,592,196 and European Patent 565,083. However, these are not used for the purpose of improving the percent of light absorption. In U.S. Pat. Nos. 3,622,317 and 3,976,493 which have an object of improving the percent of light absorption, G. B. Bird, A. L. Borror et al describe a technique of adsorbing a link type sensitizing dye molecule having a plurality of cyanine chromophores to a grain to thereby increase the percent of light absorption and effecting the sensitization by the contribution of the energy transfer. In JP-A-64-91134, Ukai, Okazaki and Sugimoto describe a technique of bonding at least one dye having substantially no adsorptivity and containing at least two sulfo groups and/or carboxyl groups to a spectral sensitizing dye capable of adsorbing to silver halide.

In U.S. Pat. No. 4,950,587, M. R. Roberts et al describe spectral sensitization by a cyanine dye polymer.

In this way, a large number of investigations have been made until now for improving the percent of light absorption, however, the effect of achieving high sensitivity is not yet satisfied and further, problems are present such as increase of the intrinsic desensitization and inhibition of the development.

Under these circumstances, a spectral sensitization technique of improving the percent of light absorption of a silver halide light-sensitive material and achieving high sensitivity is being demanded.

SUMMARY OF THE INVENTION

An object of the present invention is to provide a highly sensitive silver halide photographic light-sensitive material having a high percent of light absorption.

Another object of the present invention is provide a novel compound.

As a result of extensive investigations, these objects of the present invention can be attained by the inventions in the following items (1), (2), (3) and (4).

(1) A silver halide photographic light-sensitive material containing at least one methine compound represented by the following formula (I):

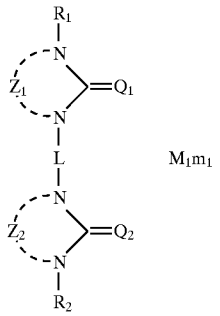

(I)

wherein $R_1$ and $R_2$ each represents an alkyl group, provided that at least one of $R_1$ and $R_2$ represents an alkyl group substituted by a dissociative group (ionizable group), $Z_1$ and $Z_2$, which may be the same or different, each represents an atomic group necessary for forming a 5- or 6-membered nitrogen-containing heterocyclic ring, L represents a divalent linking group, $M_1$ represents a charge equilibration counter ion, $m_1$ represents a number of from 0 to 10 necessary for neutralizing the electric charge of the molecule, and $Q_1$ and $Q_2$, which may be the same or different, each represents a methine group or a polymethine group necessary for forming a methine dye.

(2) The silver halide photographic light-sensitive material as described in item (1), wherein the methine compound represented by formula (I) is a methine compound represented by the following formula (II):

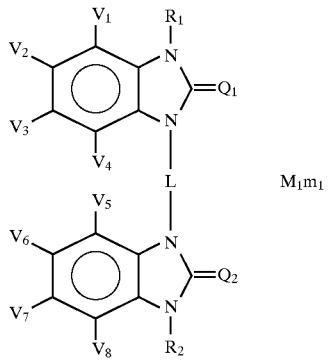

(II)

$M_1m_1$ wherein $V_1$, $V_2$, $V_3$, $V_4$, $V_5$, $V_6$, $V_7$ and $V_8$ each represents a hydrogen atom or a substituent, and L, $R_1$, $R_2$, $Q_1$, $Q_2$, $M_1$ and $m_1$ have the same meanings as defined in formula (I).

(3) A silver halide photographic light-sensitive material containing at least one methine compound represented by the following formula (III):

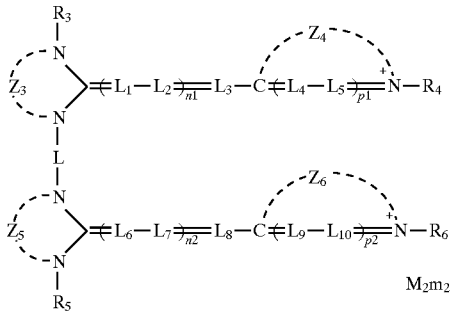

(III)

$M_2m_2$ wherein $L_1$, $L_2$, $L_3$, $L_4$, $L_5$, $L_6$, $L_7$, $L_8$, $L_9$ and $L_{10}$ each represents a methine group, $p_1$ and $p_2$ each represents 0 or 1, $n_1$ and $n_2$ each represents 0, 1, 2 or 3, $Z_3$, $Z_4$, $Z_5$ and $Z_6$ each represents an atomic group necessary for forming a 5- or 6-membered nitrogen-containing heterocyclic ring, $M_2$ represents a charge equilibration counter ion, $m_2$ represents a number of from 0 to 4 necessary for neutralizing the electric charge of the molecule, and $R_3$, $R_4$, $R_5$ and $R_6$ each represents an alkyl group, provided at least one of $R_4$ and $R_6$ represents an alkyl group substituted by a dissociative group.

(4) A methine compound represented by formula (I) described in item (1).

DETAILED DESCRIPTION OF THE INVENTION

The compound represented by formula (I) is more preferably a compound represented by the follow formula (IV):

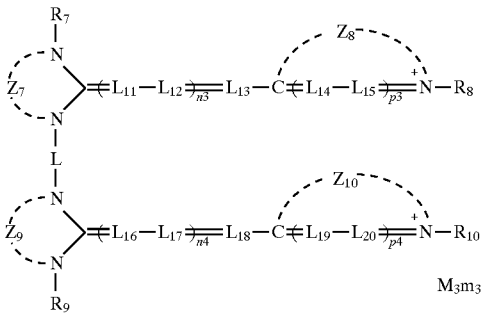

(IV)

$M_3m_3$ wherein $L_{11}$, $L_{12}$, $L_{13}$, $L_{14}$, $L_{15}$, $L_{16}$, $L_{17}$, $L_{18}$, $L_{19}$ and $L_{20}$ each represents a methine group, $p_3$ and p4 each represents 0 or 1, $n_3$ and $n_4$ each represents 0, 1, 2 or 3, $Z_7$, $Z_8$, $Z_9$ and $Z_{10}$ each represents an atomic group necessary for forming a 5- or 6- membered nitrogen-containing heterocyclic ring, $M_3$ represents a charge equilibration counter ion, $m_3$ represents a number of from 0 to 4 necessary for neutralizing the electric charge of the molecule, and $R_7$, $R_8$, $R_9$ and $R_{10}$ each represents an alkyl group, provided that at least one of $R_7$ and $R_9$ represents an alkyl group substituted by a dissociative group.

The methine compound for use in the present invention is described below in detail.

Any methine dye can be formed by $Q_1$ and $Q_2$, however, preferred examples thereof include a cyanine dye, a merocyanine dye, a rhodacyanine dye, a trinuclear merocyanine dye, an allopolar dye, a hemicyanine dye and a styryl dye. These dyes are described in detail in F. M. Hamer, *Heterocyclic Compounds—Cyanine Dyes and Related Compounds*, John Wiley & Sons, New York, London (1964), and D. M. Sturmer, *Heterocyclic Compounds—Special Topics in Heterocyclic Chemistry-*, Chap. 18, Para. 4, pp. 482–515.

The cyanine dye, the merocyanine dye and the rhodacyanine dye preferably have formulae (XI), (XII) and (XIII) described in U.S. Pat. No. 5,340,694, pp. 21–22, respectively.

In formula (I), when a cyanine dye is formed by Q, the compound can also be represented by the following resonance formula:

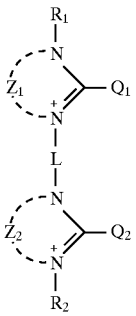

$M_1m_1$

Examples of the 5- or 6-membered nitrogen-containing heterocyclic ring formed by $Z_1$, $Z_2$, $Z_3$, $Z_5$, $Z_7$ or $Z_9$ in formulae (I), (III) and (IV) include an imidazole nucleus, a benzimidazole nucleus, imidazoline nucleus, an oxadiazole nucleus, a thiadizole nucleus, a pyrimidine nucleus and a quinazoline nucleus. Among these, preferred are an imidazole nucleus, a benzimidazole nucleus and an imidazoline nucleus, more preferred are an imidazole nucleus and a benzimidazole nucleus, still more preferred is a benzimidazole nucleus.

Examples of the 5- or 6-membered nitrogen-containing heterocyclic ring formed by $Z_4$, $Z_6$, $Z_8$ or $Z_{10}$ in formulae (III) and (IV) include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]-quinoxaline nucleus, an oxadiazole nucleus, a thiadiazole nucleus, a tetrazole nucleus and a pyrimidine nucleus.

Among these, preferred are a benzoxazole nucleus, a benzothiazole nucleus, a benzimidazole nucleus and a quinoline nucleus, more preferred are a benzoxazole nucleus and a benzimidazole nucleus.

Assuming that the substituent on $Z_1$, $Z_2$, $Z_3$, $Z_4$, $Z_5$, $Z_6$, $Z_7$, $Z_8$, $Z_9$ and $Z_{10}$ is V, the substituent represented by V is not particularly restricted, however, examples thereof include a halogen atom (e.g., chlorine, bromine, iodine, fluorine), a mercapto group, a cyano group, a carboxyl group, a phosphoric acid group, a sulfo group, a hydroxy group, a carbamoyl group having from 1 to 10, preferably from 2 to 8, more preferably from 2 to 5, carbon atoms (e.g., methylcarbamoyl, ethylcarbamoyl, morpholinocarbonyl), a sulfamoyl group having from 0 to 10, preferably from 2 to 8, more preferably from 2 to 5, carbon atoms (e.g., methylsulfamoyl, ethylsulfamoyl, piperidinosulfonyl), a nitro group, an alkoxy group having from 1 to 20, preferably from 1 to 10, more preferably from 1 to 8 carbon atoms (e.g., methoxy, ethoxy, 2-methoxyethoxy, 2-phenylethoxy), an aryloxy group having from 6 to 20, preferably from 6 to 12, more preferably from 6 to 10, carbon atoms (e.g., phenoxy, p-methylphenoxy, p-chlorophenoxy, naphthoxy), an acyl group having from 1 to 20, preferably from 2 to 10, more preferably from 2 to 8, carbon atoms (e.g., acetyl, benzoyl, trichloroacetyl), an acyloxy group having from 1 to 20, preferably from 2 to 12, more preferably from 2 to 8, carbon atoms (e.g., acetyloxy, benzoyloxy), an acylamino group having from 1 to 20, preferably from 2 to 12, more preferably from 2 to 8, carbon atoms (e.g., acetylamino), a sulfonyl group having from 1 to 20, preferably from 1 to 10, more preferably from 1 to 8, carbon atoms (e.g., methanesulfonyl, ethanesulfonyl, benzenesulfonyl), a sulfinyl group having from 1 to 20, preferably from 1 to 10, more preferably from 1 to 8, carbon atoms (e.g., methanesulfinyl, benzenesulfinyl), a sulfonylamino group having from 1 to 20, preferably from 1 to 10, more preferably from 1 to 8, carbon atoms (e.g., methanesulfonylamino, ethanesulfonylamino, benzenesulfonylamino), an amino group, a substituted amino group having from 1 to 20, preferably from 1 to 12, more preferably from 1 to 8 carbon atoms (e.g., methylamino, dimethylamino, benzylamino, anilino, diphenylamino), an ammonium group having from 0 to 15, preferably from 3 to 10, more preferably from 3 to 6, carbon atoms (e.g., trimethylammonium, triethylammonium), a hydrazino group having from 0 to 15, preferably from 1 to 10, more preferably from 1 to 6, carbon atoms (e.g., trimethylhydrazino), a ureido group having from 1 to 15, preferably from 1 to 10, more preferably from 1 to 6, carbon atoms (e.g., ureido, N,N-dimethylureido), an imido group having from 1 to 15, preferably from 1 to 10, more preferably from 1 to 6, carbon atoms (e.g., succinimido), an alkylthio or arylthio group having from 1 to 20, preferably from 1 to 12, more preferably from 1 to 8, carbon atoms (e.g., 2-pyridylthio), an alkoxycarbonyl group having from 2 to 20, preferably from 2 to 12, more preferably from 2 to 8, carbon atoms (e.g., methoxycarbonyl, ethoxycarbonyl, benzyloxycarbonyl), an aryloxycarbonyl group having from 6 to 20, preferably from 6 to 12, more preferably from 6 to 8, carbon atoms (e.g., phenoxycarbonyl), an unsubstituted alkyl group having from 1 to 18, preferably from 1 to 10, more preferably from 1 to 5, carbon atoms (e.g., methyl, ethyl, propyl, butyl), a substituted alkyl group having from 1 to 18, preferably from 1 to 10, more preferably from 1 to 5, carbon atoms (e.g., hydroxymethyl, trifluoromethyl, benzyl, carboxyethyl, ethoxycarbonylmethyl, acetylaminomethyl; the substituted alkyl group includes an unsaturated hydrocarbon group having from 2 to 18, preferably from 3 to 10, more preferably from 3 to 5, carbon atoms (e.g., vinyl, ethynyl, 1-cyclohexenyl, benzylidine, benzylidene)), a substituted or unsubstituted aryl group having from 6 to 20, preferably from 6 to 15, more preferably from 6 to 10, carbon atoms (e.g., phenyl, naphthyl, p-carboxyphenyl, p-nitrophenyl, 3,5-dichlorophenyl, p-cyanophenyl, m-fluorophenyl, p-tolyl) and a heterocyclic group having from 1 to 20, preferably from 2 to 10, more preferably from 4 to 6, carbon atoms, which may be substituted (e.g., pyridyl, 5-methylpyridyl, thienyl, furyl, morpholino, tetrahydrofurfuryl). The substituent may also have a structure where a benzene ring or a naphthalene ring is condensed.

The substituent may further be substituted by V.

The substituent is preferably the above-described alkyl group, aryl group, alkoxy group, halogen atom or benzene ring condensation, more preferably a methyl group, a phenyl group, a methoxy group, a chlorine atom, a bromine atom, an iodine atom or a benzene ring condensation.

In formulae (I), (II), (III) and (IV), $R_1$, $R_2$, $R_3$, $R_4$, $R_5$, $R_6$, $R_7$, $R_8$, $R_9$ and $R_{10}$ each represents an alkyl group. Examples of the alkyl group represented by $R_1$, $R_2$, $R_3$, $R_4$, $R_5$, $R_6$, $R_7$, $R_8$, $R_9$ or $R_{10}$ include an unsubstituted alkyl group having from 1 to 18, preferably from 1 to 7, more preferably from 1 to 4, carbon atoms (e.g., methyl, ethyl, propyl, isopropyl, butyl, isobutyl, hexyl, octyl, dodecyl, octadecyl) and a substituted alkyl group having from 1 to 18, preferably from 1 to 7, more preferably from 1 to 4, carbon atoms. Examples of the substituent include those described above with respect to the substituent V. The alkyl group is preferably an alkyl group substituted by a non-dissociative group (a substituent other than the substituents described later as the dissociative group) {for example, a halogenated alkyl group (examples of the substituent include chloro, bromo, fluoro and iodo), an aralkyl group (e.g., benzyl, 2-phenylethyl), an unsaturated hydrocarbon group (e.g., allyl, crotyl), a hydroxyalkyl group (e.g., 2-hydroxyethyl, 3-hydroxypropyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy) ethyl), an alkoxycarbonylalkyl group (e.g., ethoxycarbonylethyl, 2-benzyloxycarbonylethyl), an aryloxycarbonylalkyl group (e.g., 3-phenoxycarbonylpropyl, 2-(1-naphthoxycarbonyl)ethyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl) or a heterocyclic ring-substituted alkyl group (e.g., 2-(pyrrolidin-2-on-1-yl)ethyl)} or an alkyl group substituted by a dissociative group (the dissociative group means a proton dissociative group, namely, an acidic group, and includes the substituents described below) {for example, a carboxyalkyl group having from 1 to 18, preferably from 1 to 7, more preferably from 1 to 5, carbon atoms (e.g., 2-carboxyethyl, 3-carboxypropyl, 4-carboxybutyl, carboxymethyl; the group may further be substituted and examples of the substituent include those described above with respect to the substituent V), a carboxyalkenyl group having from 1 to 18, preferably from 1 to 7, more preferably from 1 to 4, carbon atoms (e.g., carboxyallyl; the group may further be substituted and examples of the substituent include those described above with respect to the substituent V), a sulfonyl group having from 1 to 18, preferably from 1 to 7, more preferably from 1 to 4, carbon atoms (e.g., 2-sulfoethyl, 3-sulfopropyl, 4-sulfobutyl, 2-[3-sulfopropoxy]ethyl, 2-hydroxy-3-sulfopropyl, 3-sulfopropoxyethoxyethyl; the group may further be substituted and examples of the substituent include those described above with respect to the substituent V), a sulfoalkenyl group having from 1 to 18, preferably from 1 to 7, more preferably from 1 to 4 carbon atoms (e.g., sulfoallyl; the group may further be substituted and examples of the substituent include those described above with respect to the substituent V), a sulfatoalkyl group having from 1 to 18, preferably from 1 to 7, more preferably from 1 to 4, carbon atoms (e.g., 2-sulfatoethyl, 3-sulfatopropyl, 4-sulfatobutyl; the group may further be substituted and examples of the substituent include those described above with respect to the substituent V), a phosphonoalkyl group having from 1 to 18, preferably from 1 to 7, more preferably from 1 to 4, carbon atoms (e.g., 2-phosphonoethyl, 3-phosphonopropyl, 4-phosphonobutyl; the group may further be substituted and examples of the substituent include those described above with respect to the substituent V), an alkylsulfonylcarbamoylalkyl group (e.g., methanesulfonylcarbamoylmethyl group), an acylcarbamoylalkyl group (e.g., acetylcarbamoylmethyl), an acylsulfamoylalkyl group (e.g., acetylsulfamoylmethyl) or an alkylsulfonylsulfamoylalkyl group (e.g., methanesulfonylsulfamoylmethyl)}.

In formulae (I) and (II), at least one of $R_1$ and $R_2$ represents an alkyl group substituted by the above-described dissociative group. $R_1$ and $R_2$ both may be an alkyl group substituted by a dissociative group, however, it is preferred that one of $R_1$ and $R_2$ is an alkyl group substituted by a dissociative group and the other is an alkyl group not substituted by a dissociative group, namely, an unsubstituted group or an alkyl group substituted by a non-dissociative group.

In formula (III), at least one of $R_4$ and $R_6$ represents an alkyl group substituted by the above-described dissociative group. $R_4$ and $R_6$ both may be an alkyl group substituted by a dissociative group, however, it is preferred that one of $R_4$ and $R_6$ is an alkyl group substituted by a dissociative group and the other is an alkyl group not substituted by a dissociative group, namely, an unsubstituted group or an alkyl group substituted by a non-dissociative group.

In formula (IV), at least one of $R_7$ and $R_9$ represents an alkyl group substituted by the above-described dissociative group. $R_7$ and $R_9$ both may be an alkyl group substituted by a dissociative group, however, it is preferred that one of $R_7$ and $R_9$ is an alkyl group substituted by a dissociative group and the other is an alkyl group not substituted by a dissociative group, namely, an unsubstituted group or an alkyl group substituted by a non-dissociative group.

The alkyl group substituted by a dissociative group is preferably a carboxyalkyl group having from 1 to 5 carbon atoms (e.g., 2-carboxyethyl, 3-carboxypropyl, 4-carboxybutyl, carboxymethyl), a sulfoalkyl group having from 1 to 4 carbon atoms (e.g., 2-sulfoethyl, 3-sulfopropyl, 4-sulfobutyl), a sulfoalkenyl group having from 1 to 4 carbon atoms (e.g., sulfoallyl) or an alkylsulfonylcarbamoylalkyl group (e.g., methanesulfonylcarbamoylmethyl), more preferably a sulfoalkyl group having from 1 to 4 carbon atoms (e.g., 2-sulfoethyl, 3-sulfopropyl, 4-sulfobutyl).

The alkyl group not substituted by a dissociative group is preferably an unsubstituted alkyl group having from 1 to 18 carbon atoms (e.g., methyl, ethyl, propyl, isopropyl, butyl, isobutyl, hexyl, octyl, dodecyl, octadecyl), an alkyl group substituted by a non-dissociative group {for example, an aralkyl group (e.g., benzyl, 2-phenylethyl), an unsaturated hydrocarbon group (e.g., allyl, crotyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy)ethyl), an alkoxycarbonylalkyl group (e.g., ethoxycarbonylethyl, 2-benzyloxycabonylethyl), an aryloxycarbonylalkyl group (e.g., 3-phenoxycarbonylpropyl, 2-(1-naphthoxycarbonyl)ethyl), an acryloxyalkyl group (e.g., 2-acetyloxyethyl) or an acylalkyl group (e.g., 2-acetylethyl)}, more preferably an unsubstituted alkyl group having from 1 to 18 carbon atoms (e.g., methyl, ethyl, propyl, isopropyl, butyl, isobutyl, hexyl, octyl, dodecyl, octadecyl), still more preferably methyl, ethyl, propyl, isopropyl or butyl.

In formulae (III) and (IV), $R_3$ and $R_5$, and $R_8$ and $R_{10}$ each may be any of an unsubstituted alkyl group, an alkyl group substituted by a non-dissociative group and an alkyl group substituted by a dissociative group, but preferably an unsubstituted alkyl group having from 1 to 18 carbon atoms, an aralkyl group, an unsaturated hydrocarbon group, an alkoxyalkyl group, an aryloxyalkyl group, a carboxyalkyl group having from 1 to 5 carbon atoms (e.g., 2-carboxyethyl, 3-carboxypropyl, 4-carboxybutyl, carboxymethyl), a sulfoalkyl group having from 1 to 4 carbon atoms (e.g., 2-sulfoethyl, 3-sulfopropyl, 4-sulfobutyl), a sulfoalkenyl group having from 1 to 4 carbon atoms (e.g., sulfoallyl) or an alkylsulfonylcarbamoylalkyl group (e.g., methanesulfonylcarbamoylmethyl), more preferably an unsubstituted alkyl group having from 1 to 18 carbon atoms, a carboxyalkyl group having from 1 to 5 carbon atoms, a sulfoalkyl group having from 1 to 4 carbon atoms or a sulfoalkenyl group having from 1 to 4 carbon atoms, still more preferably a sulfoalkyl group having from 1 to 4 carbon atoms (e.g., 2-sulfoethyl, 3-sulfopropyl, 4-sulfobutyl).

L represents a divalent linking group. The linking group comprises atoms or an atomic group containing at least one of a carbon atom, a nitrogen atom, a sulfur atom and an oxygen atom. Preferred examples thereof include an alkylene group having from 1 to 20 carbon atoms (e.g., ethylene, propylene, butylene, 1-methylethylene, 2-methylpropylene; the group may be substituted and examples of the substituent include those described above with respect to the substituent V; the alkylene group may have intervention of a hetero atom (e.g., oxygen, sulfur, nitrogen), an aryl group (e.g., 1,2-phenylene, 1,3-phenylene, 1,4-phenylene, 1,2-naphthylene) or a heterocyclic ring (e.g., 2,3-pyridylene)), an alkenylene group having from 1 to 20 carbon atoms (e.g., 1,2-ethenylene, 1-methyl-1,2-ethenylene, 1,2-dimethyl-1,2-ethenylene, 1,3-(1-propenylene), 1,4-(2-butenylene); the group may be substituted and examples of the substituent include those described above with respect to the substituent V) and an alkynylene group having from 1 to 20 carbon atoms (e.g., ethynylene, propynylene; the group may be substituted and examples of the substituent include those described above with respect to the substituent V).

L is more preferably an alkylene group or an alkenylene group, still more preferably an unsubstituted alkylene group having from 1 to 10 carbon atoms.

$V_1$, $V_2$, V3, $V_4$, $V_5$, $V_6$, $V_7$ and $V_8$ each represents a hydrogen atom or a substituent. Examples of the substituent include those described above with respect to the substituent V. $V_1$, $V_2$, $V_3$, $V_4$, $V_5$, $V_6$, $V_7$ and $V_8$ each is preferably a hydrogen atom, a halogen atom (particularly preferably, chloro or bromo), an alkyl group, a cyano group, an acyl group or an amino group, more preferably a hydrogen atom, a halogen atom, a methyl group or an ethyl group.

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$ and $L_{20}$ each independently represents a methine group. The methine group represented by $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$ or $L_{20}$ may have a substituent and examples of the substituent include a substituted or unsubstituted alkyl group having from 1 to 15, preferably from 1 to 10, more preferably from 1 to 5, carbon atoms (e.g., methyl, ethyl, 2-carboxyethyl), a substituted or unsubstituted aryl group having from 6 to 20, preferably from 6 to 15, more preferably from 6 to 10, carbon atoms (e.g., phenyl, o-carboxyphenyl), a substituted or unsubstituted heterocyclic group having from 3 to 20, preferably from 4 to 15, more preferably from 6 to 10, carbon atoms (e.g., N,N-diethylbarbituric acid group), a halogen atom (e.g., chlorine, bromine, fluorine, iodine), an alkoxy group having from 1 to 15, preferably from 1 to 10, more preferably from 1 to 5, carbon atoms (e.g., methoxy, ethoxy), an alkylthio group having from 1 to 15, preferably from 1 to 10, more preferably from 1 to 5, carbon atoms (e.g., methylthio, ethylthio), an arylthio group having from 6 to 20, preferably from 6 to 15, more preferably from 6 to 10, carbon atoms (e.g., phenylthio) and an amino group having from 0 to 15, preferably from 2 to 10, more preferably from 4 to 10, carbon atoms (e.g., N,N-diphenylamino, N-methyl-N-phenylamino, N-methylpiperazino). The methine group may form a ring together with other methine group or form a chromophoric ring.

$n_1$, $n_2$, $n_3$ and $n_4$ each is preferably 0, 1, 2 or 3, more preferably 0 or 1, still more preferably 1. When $n_1$, $n_2$, $n_3$ and $n_4$ each is 2 or more, the methine group is repeated but the methine groups need not be the same.

$M_1$, $M_2$ and $M_3$ are included in the formulae so as to show the presence of a cation or anion when necessary for neutralizing the ion charge of the dye. Typical examples of the cation include an inorganic cation such as hydrogen ion ($H^+$), alkali metal ion (e.g., sodium ion, potassium ion, lithium ion) and alkaline earth metal ion (e.g., calcium ion), and an organic ion such as ammonium ion (e.g., ammonium ion, tetraalkylammonium ion, pyridinium ion, ethylpyridinium ion). The anion may be either an inorganic anion or an organic anion, and examples thereof include a halogen anion (e.g., fluorine ion, chlorine ion, iodine ion), a substituted aryl sulfonate ion (e.g., p-toluene sulfonate ion, p-chlorobenzene sulfonate ion), an aryl disulfonate ion (e.g., 1,3-benzene sulfonate ion, 1,5-naphthalene disulfonate ion, 2,6-naphthalene disulfonate ion), an alkyl sulfate ion (e.g., methyl sulfate ion), a sulfate ion, a thiocyanate ion, a peracid chlorate ion, a tetrafluoroborate ion, picrate ion, an acetate ion and a trifluoromethane sulfonate ion. An ionic polymer or other dye having reversed charge to the dye may also be used.

$m_1$, $m_2$ and $m_3$ each represents a number necessary for equilibrating the charge and when an inner salt is formed, $m_1$, $m_2$ and $m_3$ each is 0.

$p_1$, $p_2$, $p_3$ and p4 each independently represents 0 or 1, preferably 0.

The number of the methine group in $Q_1$ or $Q_2$ is preferably from 0 to 7, more preferably from 0 to 5, still more preferably 3. The methine group is preferably substituted by a substituent (for example, a heterocyclic group, an aliphatic group or an aromatic group) necessary for forming a methine dye, and the substituent is preferably a heterocyclic group or an aromatic group, more preferably a heterocyclic group. Preferred examples of the heterocyclic group include those described above as examples for $Z_4$ and $Z_6$.

The aromatic group include a substituted or unsubstituted aromatic group (e.g., 4-dimethylaminophenyl, 4-methoxyphenyl, phenyl, 4-dimethylaminonaphthyl).

The aliphatic group is preferably an alkoxycarbonyl group (e.g., ethoxycarbonyl) or an acyl group (e.g., acetyl). Further, the aliphatic group includes those described above with respect to the substituent V and for example, a substituted or unsubstituted amino group (e.g., amino, dimethylamino), a cyano group, an alkoxycarbonyl group (e.g., ethoxycarbonyl), a substituted or unsubstituted alkylsulfonyl group (e.g., methylsulfonyl) and a substituted or unsubstituted acyl group (e.g., acetyl) are preferred.

Specific examples of the compound represented by formula (I) (including the compounds represented by formulae (II) and (IV) as subordinate concepts) of the present invention are set forth below, however, the present invention is by no means limited thereto.

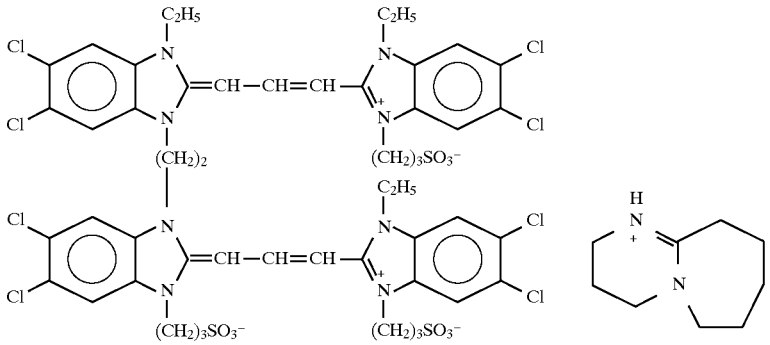

(1)

-continued
(2)
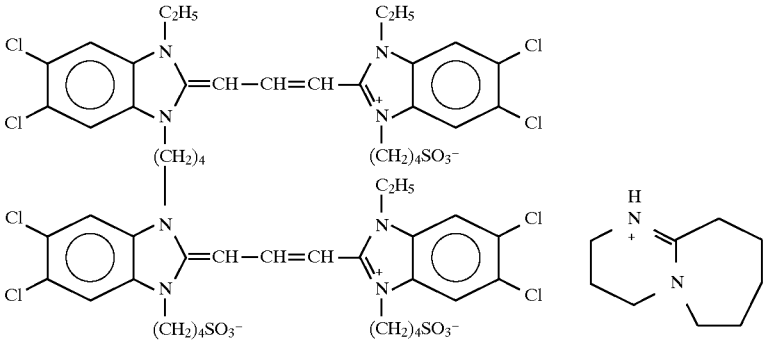
(3)
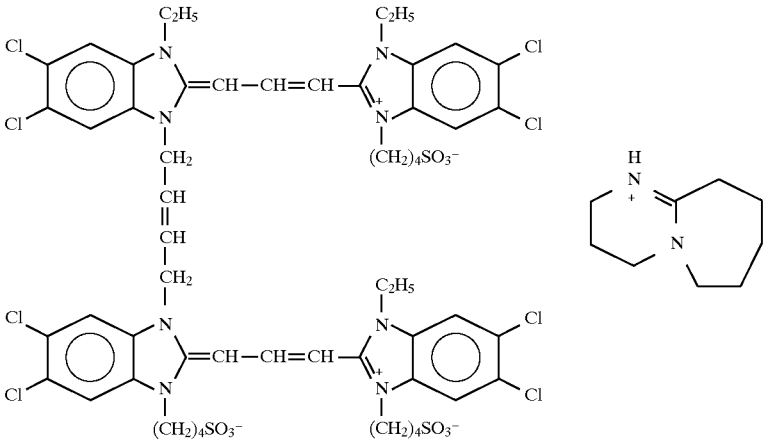
(4)
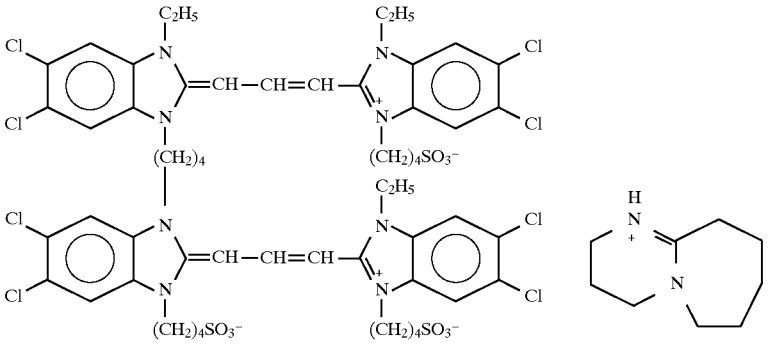
(5)
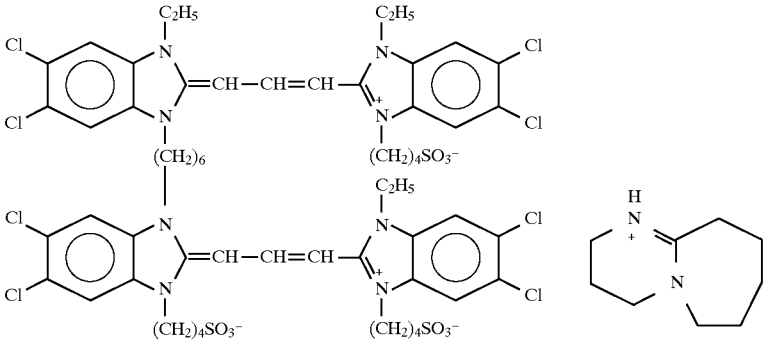

-continued
(6)
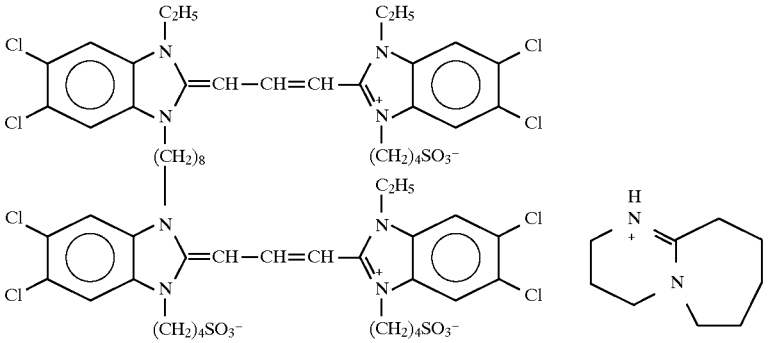
(7)
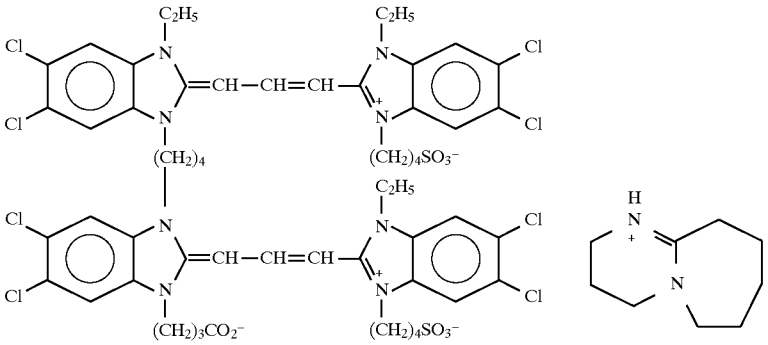
(8)
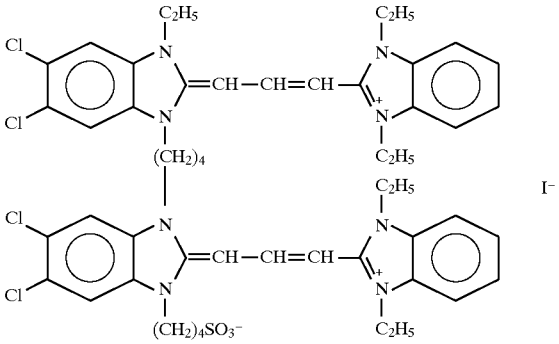
(9)
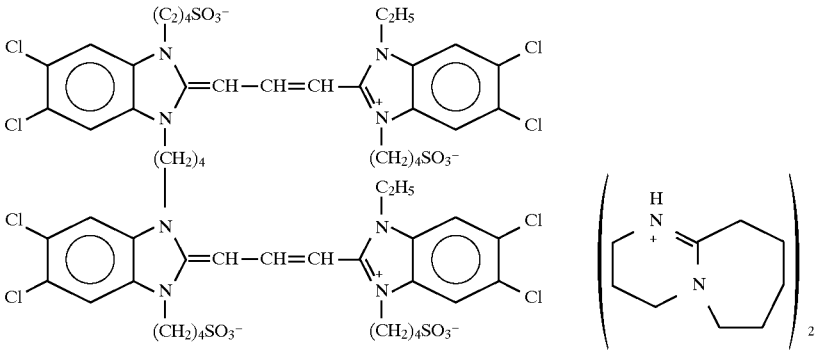

-continued
(10)
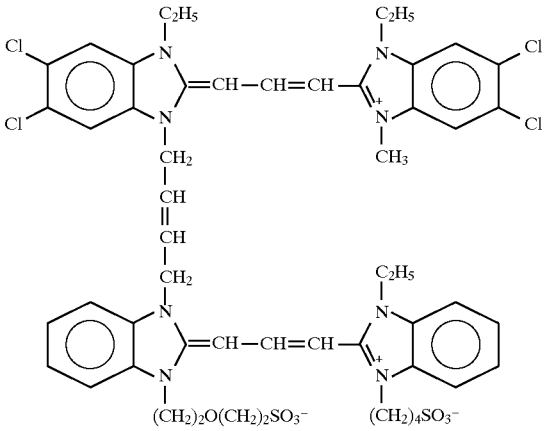
(11)
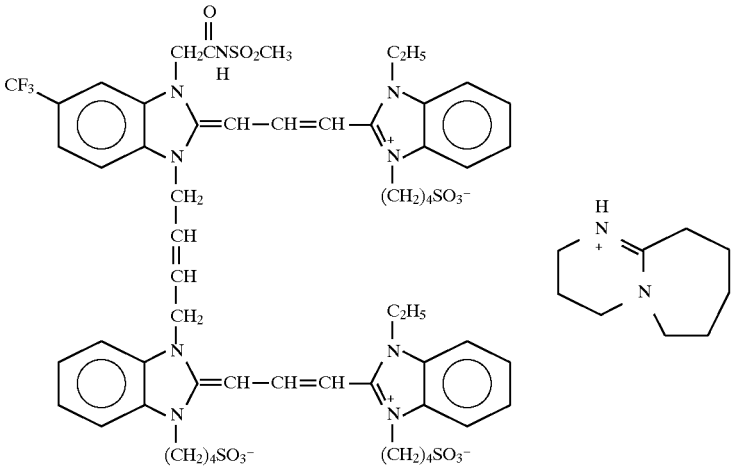
(12)
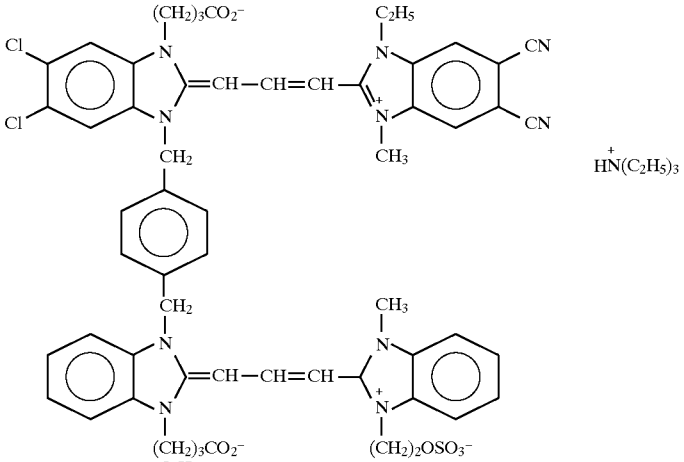
(13)
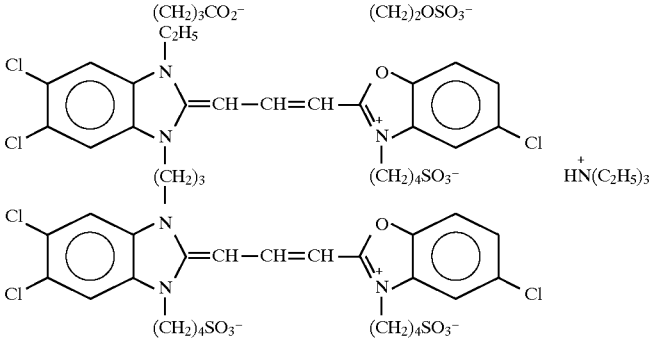

-continued
(14)
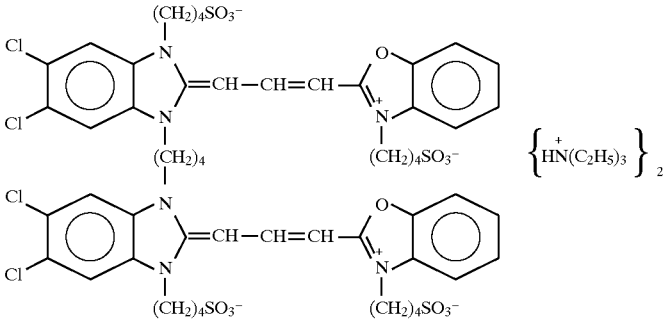
(15)
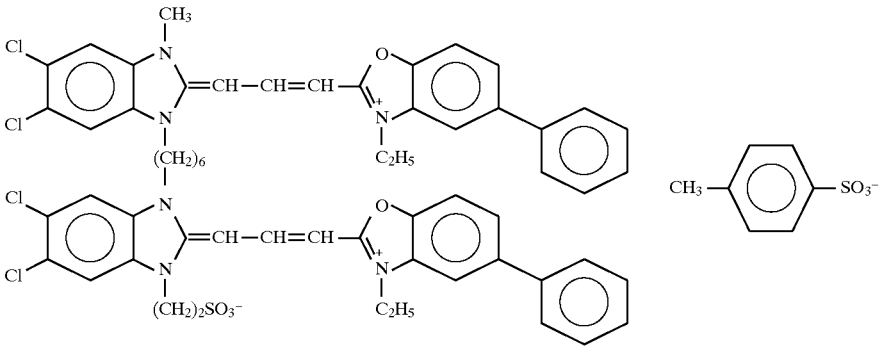
(16)
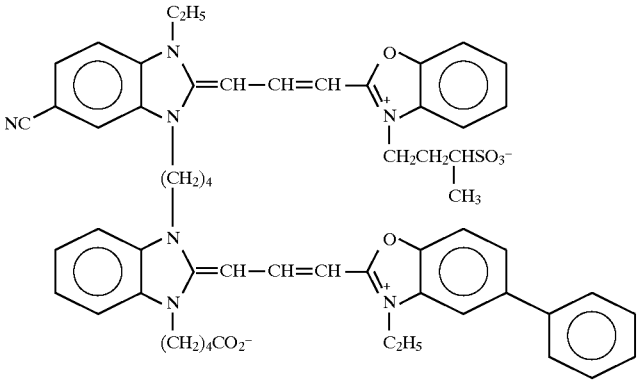
(17)
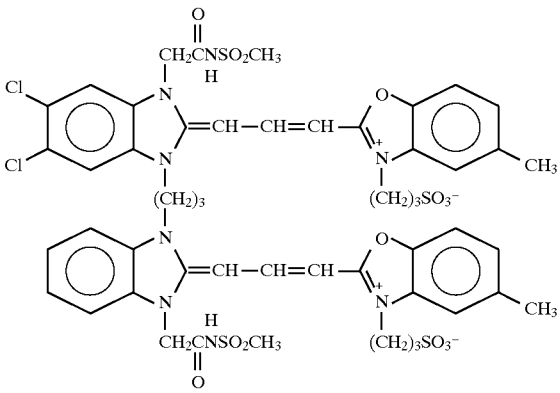

-continued
(18)
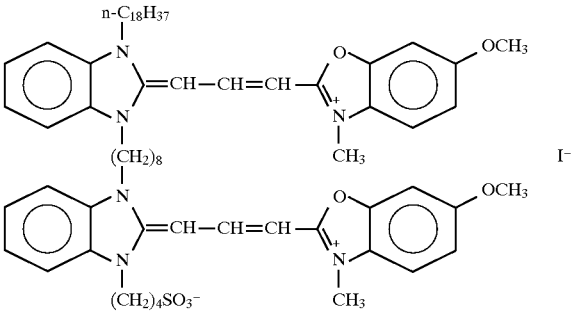
(19)
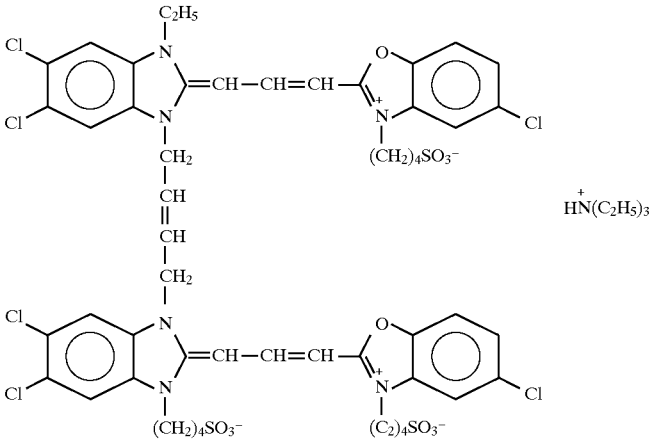
(20)
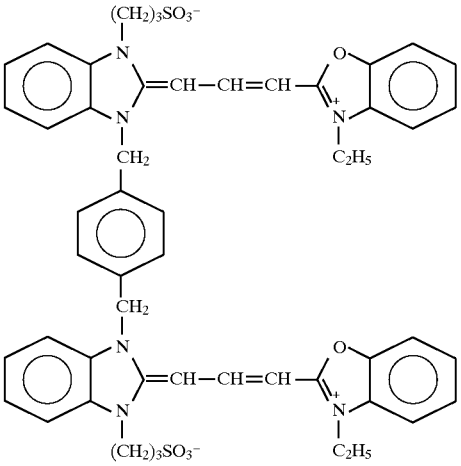
(21)
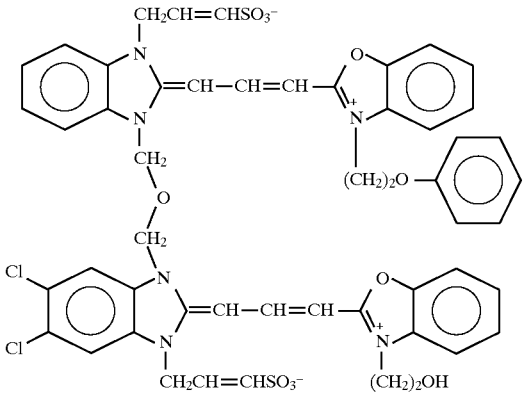

-continued
(22)
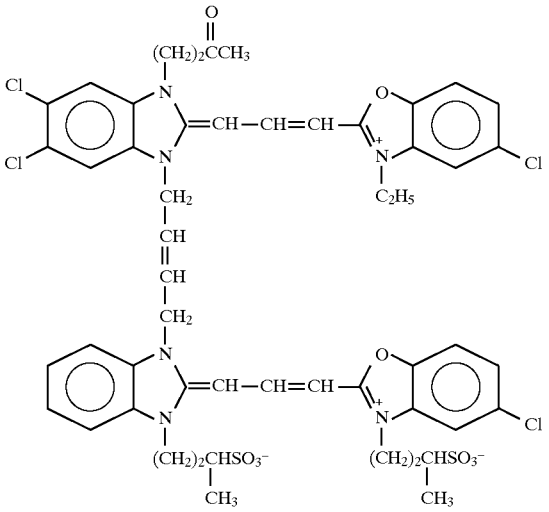
(23)
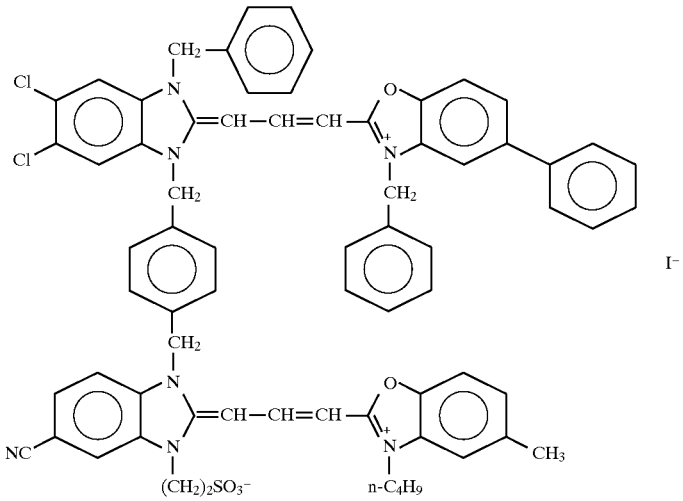
(24)
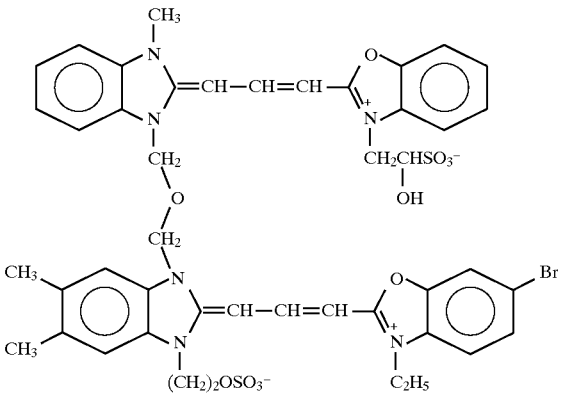

-continued
(25)
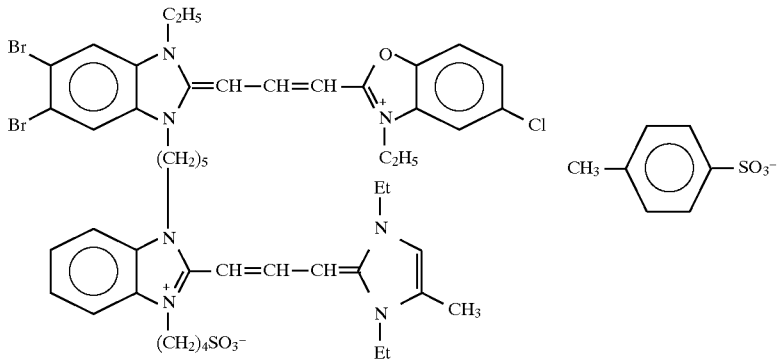
(26)
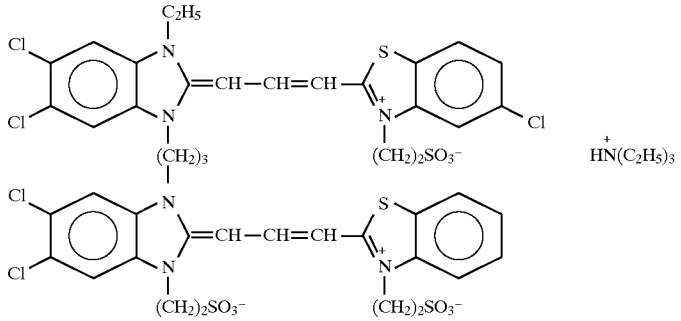
(27)
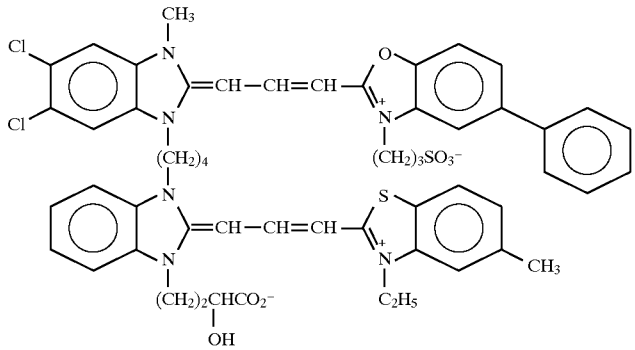
(28)
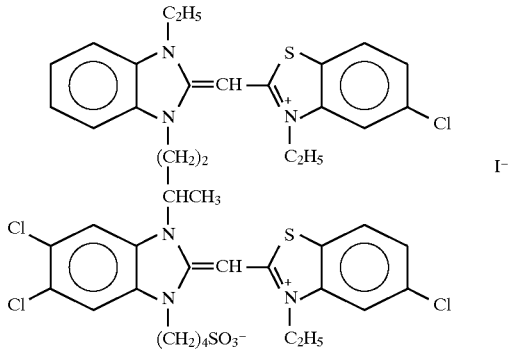

-continued
(29)
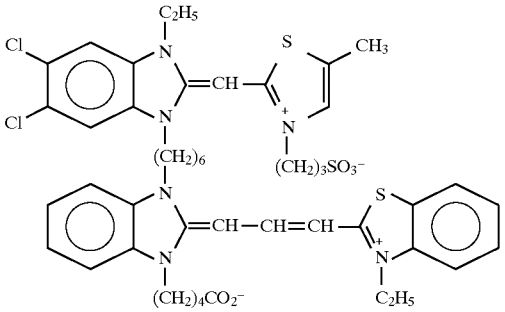
(30)
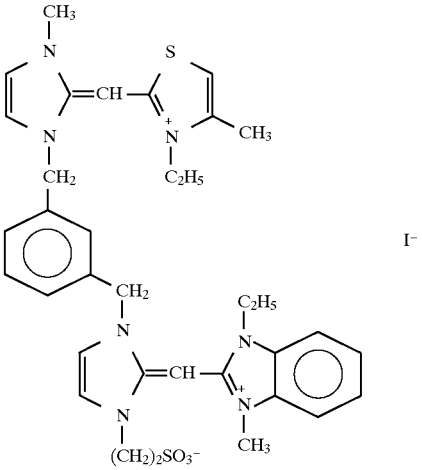
(31)
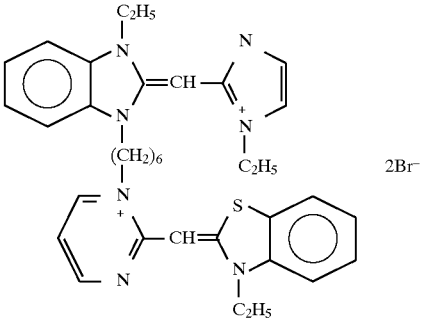
(32)
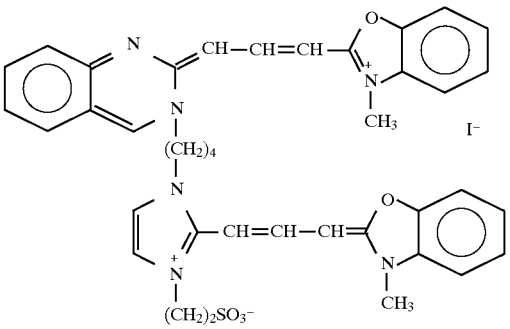

-continued
(33)
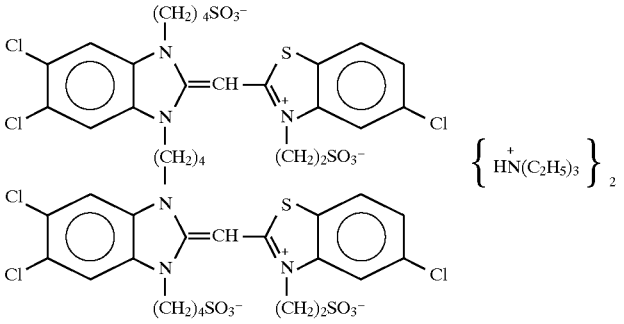
(34)
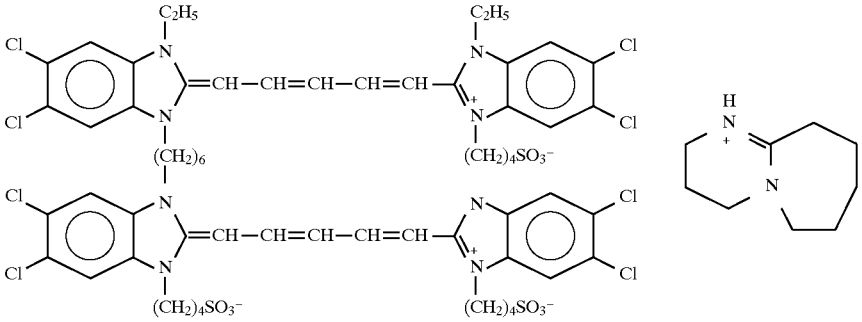
(35)
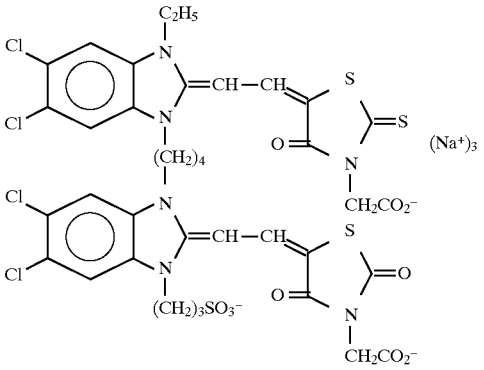
(36)
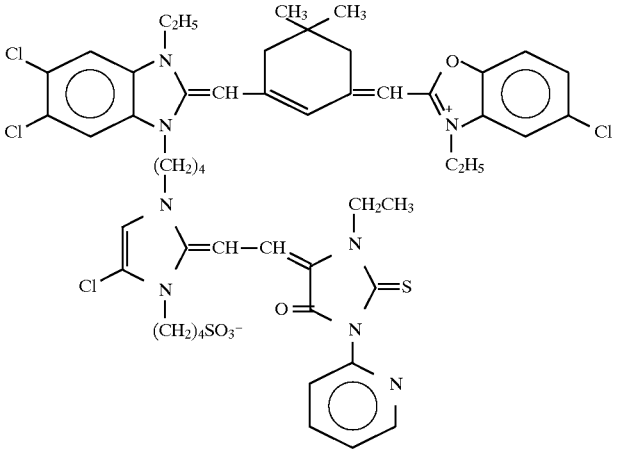

-continued (37)

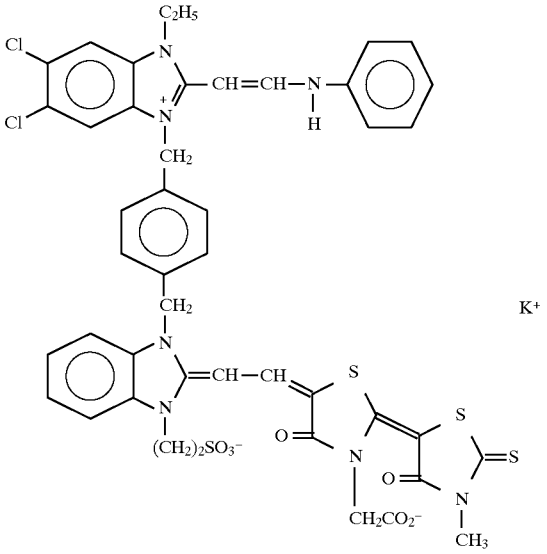

Specific examples of the compound represented by formula (III) of the present invention are set forth below, however, the present invention is by no means limited thereto.

Out of the specific examples of the compound represented by formula (I), Compounds (1) to (7), (9) to (14), (16), (17), (19), (22), (24), (26), (27), (29), (33) and (34) are included in the compound represented by formula (III). Additional specific examples of the compound represented by formula (III) are set forth below.

(38)

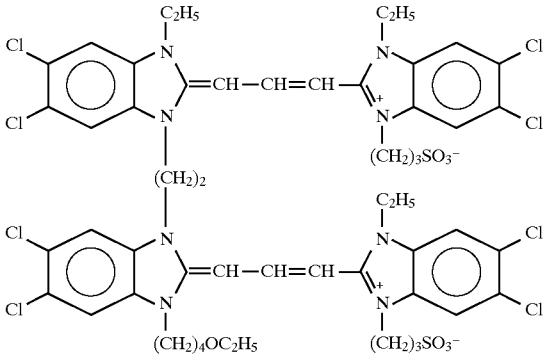

(39)

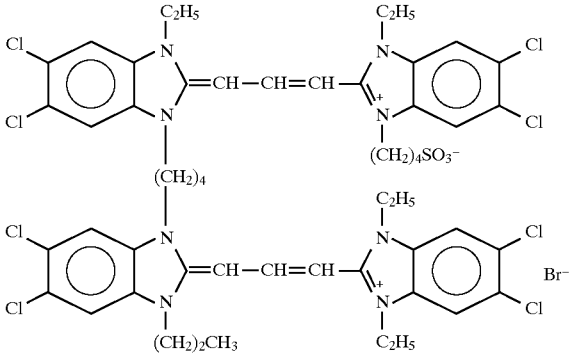

-continued
(40)
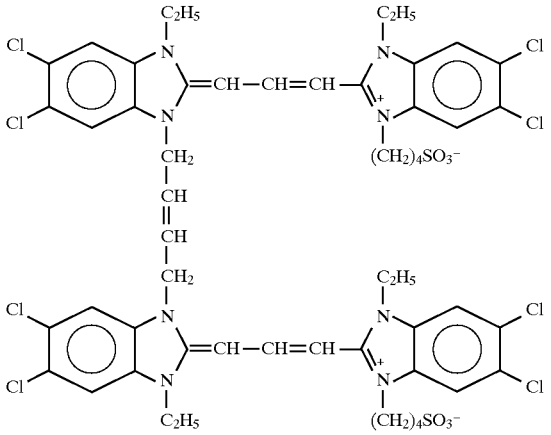
(41)
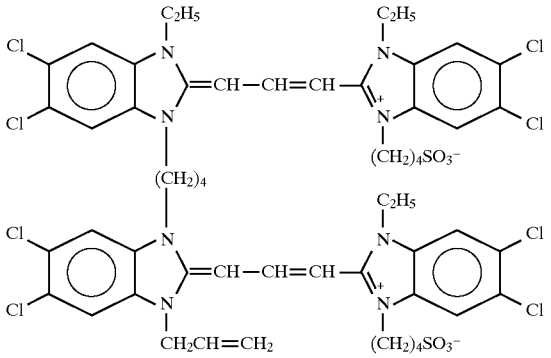
(42)
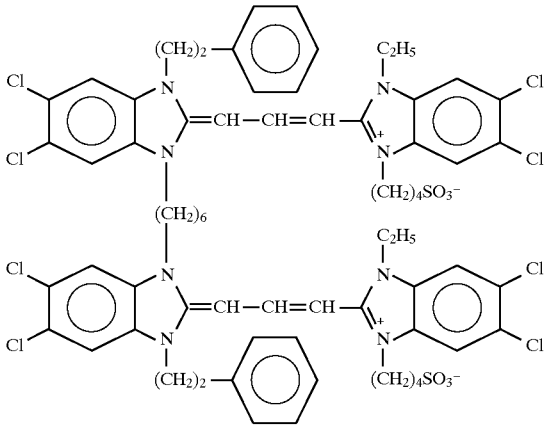
(43)
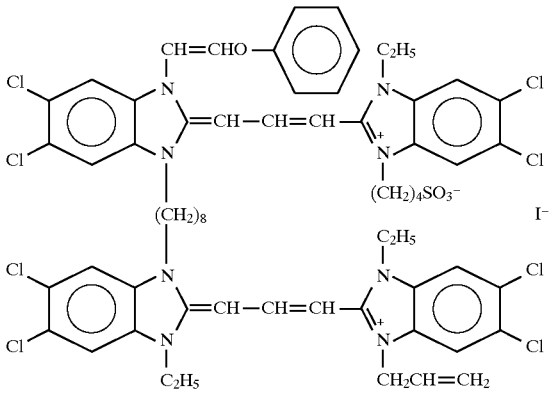

-continued
(44)
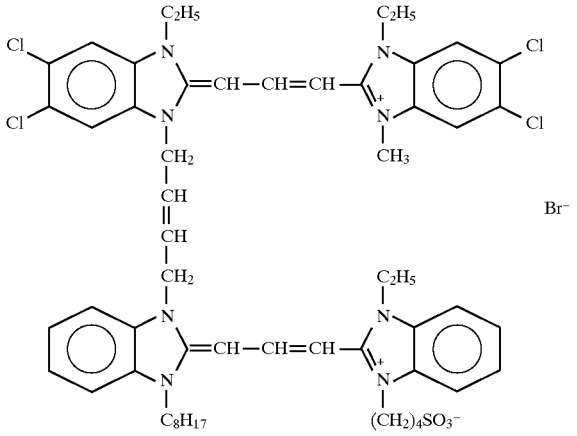
(45)
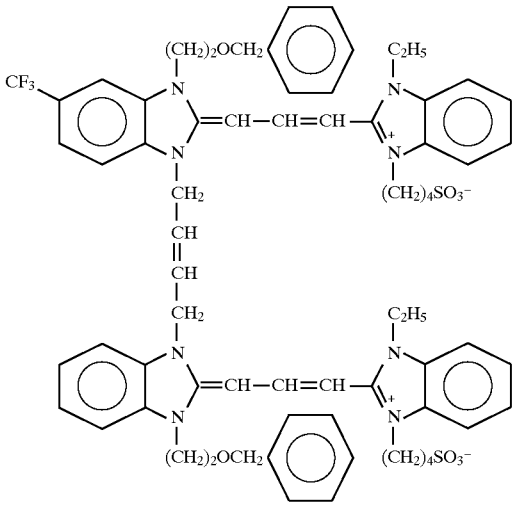
(46)
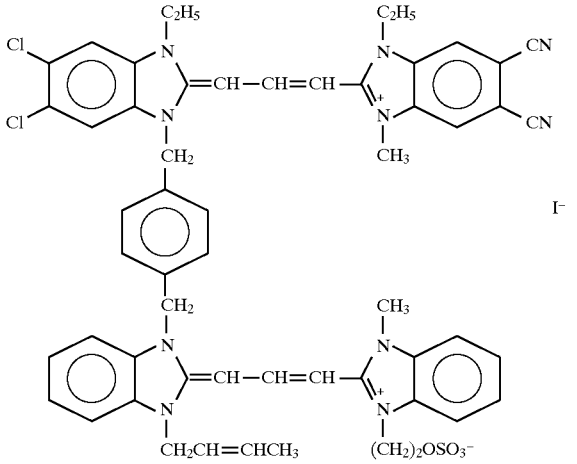

-continued
(47)
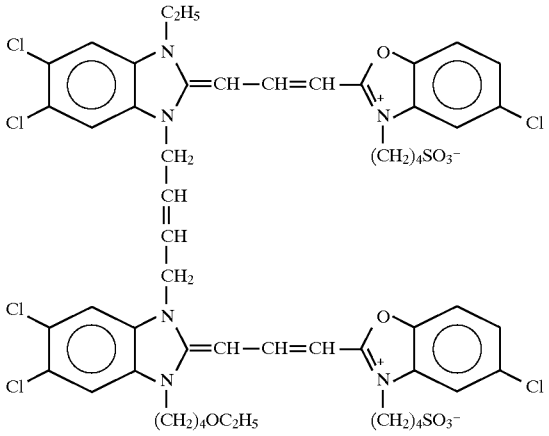
(48)
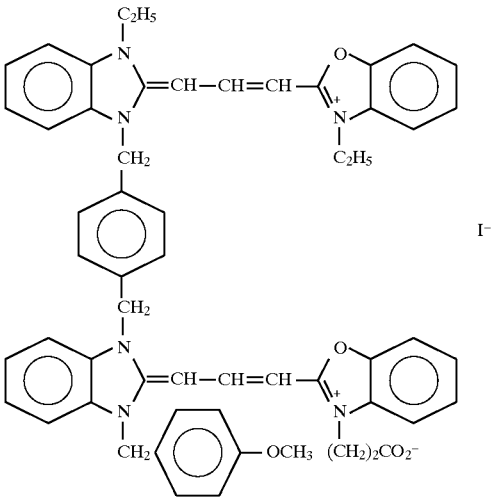
(49)
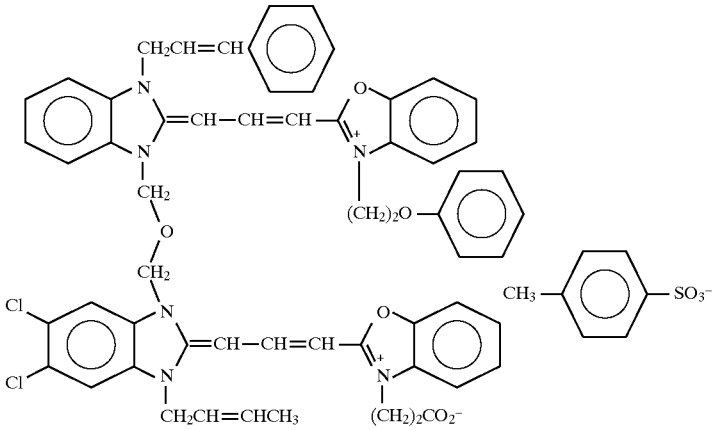

-continued
(50)
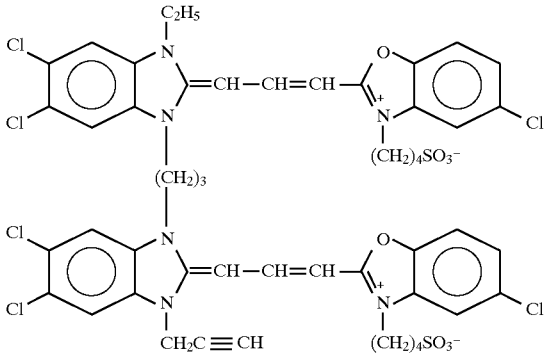
(51)
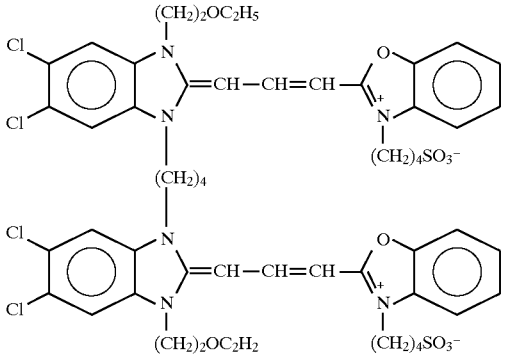
(52)
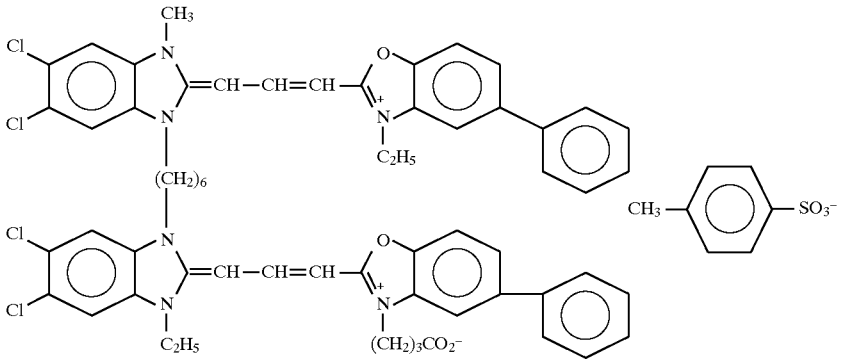
(53)
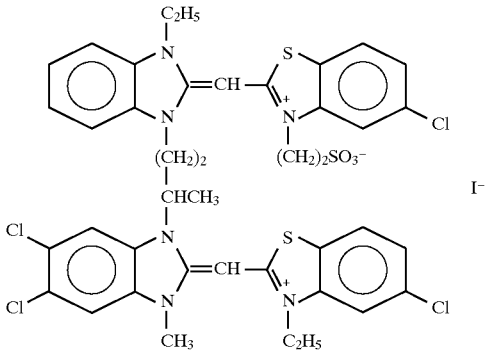

-continued (54)

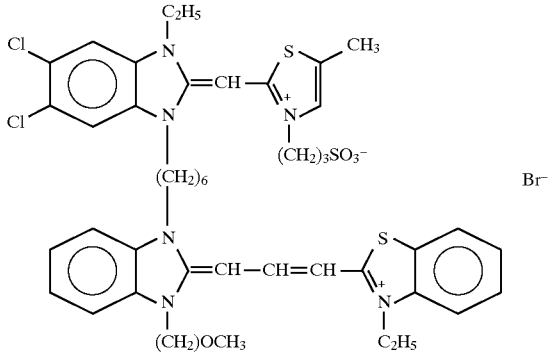

(55)

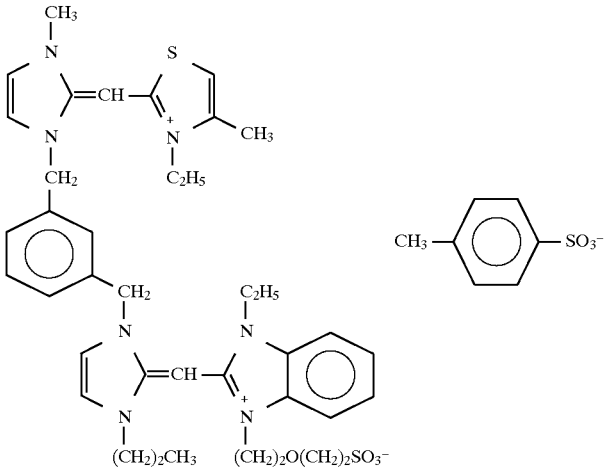

(56)

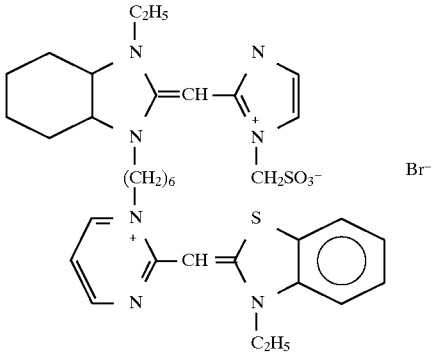

(57)

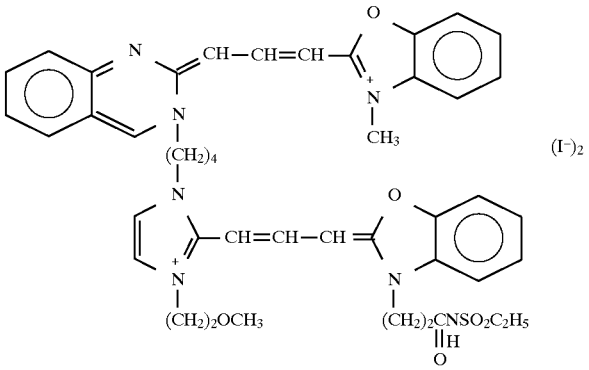

The compound represented by formula (I) (including the compounds represented by formulae (II) and (III) as subordinate concepts) of the present invention can be synthesized by referring to F. M. Hamer, *Heterocyclic Compounds—Cyanine Dyes and Related Compounds*, John Wiley & Sons, New York, London (1964), D. M. Sturmer, *Heterocyclic Compounds—Special Topics in Heterocyclic Chemistry-*, Chap. 18, Para. 14, pp. 482–515, John Wiley & Sons, New York, London (1977), *Rodd's Chemistry of Carbon Compounds*, 2nd. Ed., Vol. IV, Part B, Chap. 15, pp. 369–422, Elsevier Science Publishing Company Inc., New York (1977).

The methine compound represented by formula (I) of the present invention (hereinafter referred to as the methine compound of the present invention) can be used individually or in combination with other sensitizing dye in a silver halide photographic light-sensitive material.

The methine compound-of the present invention (the same goes for other sensitizing dye) may be added to the silver halide emulsion of the present invention in any step known to be useful during the preparation of emulsion. For example, the compound may be added during grain formation of silver halide and/or before desalting or during desalting and/or between after desalting and before initiation of chemical ripening as disclosed in U.S. Pat. Nos. 2,735,766, 3,628,960, 4,183,756 and 4,225,666, JP-A-58-184142 and JP-A-60-196749, or may be added at any time or step before coating of the emulsion such as immediately before or during chemical ripening or after chemical ripening but before coating as disclosed in JP-A-58-113920. Also, as disclosed in U.S. Pat. No. 4,225,666 and JP-A-58-7629, the same compound alone or in combination with a compound having a different structure may be added in parts, for example, a part during grain formation and the remaining during chemical ripening or after completion of the chemical ripening, or a part before or during chemical ripening and the remaining after completion of the chemical ripening, and the kind of the compounds added in parts or the combination of the compounds may be changed.

The addition amount of the methine compound of the present invention varies depending upon the shape or size of the silver halide grain but it may be from $1\times10^{-6}$ to $8\times10^{-3}$ mol per mol of silver halide. For example, in the case when the silver halide grain size is from 0.2 to 1.3 $\mu$m, the addition amount is preferably from $2\times10^{-6}$ to $3.5\times10^{-3}$ mol, more preferably from $7.5\times10^{-6}$ to $1.5\times10^{-3}$ mol, per mol of silver halide.

The methine compound of the present invention may be dispersed directly in the emulsion or may be added to the emulsion in the form of a solution after dissolving it in an appropriate solvent such as methyl alcohol, ethyl alcohol, methyl cellosolve, acetone, water, pyridine or a mixed solvent thereof. At this time, a base, an acid or additives such as a surface active agent may be present together. Further, an ultrasonic wave may be used in the dissolution. Furthermore, the methine compound may be added by a method where the compound is dissolved in a volatile organic solvent, the solution is dispersed in a hydrophilic colloid and the dispersion is added to the emulsion as described in U.S. Pat. No. 3,469,987, a method where the compound is dispersed in a water-soluble solvent and the dispersion is added to the emulsion as described in JP-B-46-24185, a method where the methine compound is dissolved in a surface active agent and the solution is added to the emulsion as described in U.S. Pat. No. 3,822,135, a method where the compound is dissolved using a compound capable of red shifting and the solution is added to the emulsion as described in JP-A-51-74624, or a method where the methine compound is dissolved in an acid containing substantially no water and the solution is added to the emulsion as described in JP-A-50-80826. In addition, the compound may be added to the emulsion using the methods described in U.S. Pat. Nos. 2,912,343, 3,342,605, 2,996,287 and 3,429,835.

The methine compound of the present invention may also be used as a filter dye, an irradiation preventive dye or an antihalation dye for various purposes such as improvement of sharpness and color separation capability.

The methine compound can be incorporated into a coating solution for a silver halide photographic light-sensitive layer, a filter layer and/or an antihalation layer by a usual method. The use amount of the dye may be enough if it can color the photographic layer and one skilled in the art may easily select the amount appropriately depending upon the end use. In general, the dye is preferably used so that the optical density can fall within the range of from 0.05 to 3.0.

The dye may be added at any step before the coating.

A polymer having a reversed charge to the dye ion may be present together in the layer so as to localize the dye in a specific layer by the interaction of the polymer with the dye molecule.

Examples of the polymer mordant include those described in U.S. Pat. Nos. 2,548,564, 4,124,386, 3,625,694, 3,958,995, 4,168,976 and 3,445,231.

Examples of the supersensitizer useful in the spectral sensitization for use in the present invention include pyrimidylamino compounds, triazinylamino compounds and azolium compounds described in U.S. Pat. Nos. 3,511,664, 3,615,613, 3,615,632, 3,615,641, 4,596,767, 4,945,038, 4,965,182 and 4,965,182, and with respect to the use method thereof, the methods described in these patents are also preferred.

The silver halide emulsion which can be used in the silver halide light-sensitive material of the present invention may use any of silver bromide, silver iodobromide, silver iodochlorobromide and silver chlorobromide. Preferred silver halides are silver bromide, silver chlorobromide, silver iodochlorobromide and high silver chloride described in JP-A-2-42.

The constitution and processing of the light-sensitive material are described below, however, the constitution and processing described in JP-A-2-42 are preferably used particularly in the case of high silver chloride.

The constitution and the processing described in JP-A-63-264743 are preferably used particularly in the case of silver chlorobromide.

The silver halide grain may comprise phases different between the inside and the surface layer or may comprise a homogeneous phase. A grain where a latent image is mainly formed on the surface (for example, a negative light-sensitive material), a grain where a latent image is mainly formed in the inside of the grain (for example, an internal latent image-type light-sensitive material) or a previously fogged grain (for example, a direct positive light-sensitive material) may be used.

The silver halide grains having various halogen compositions, crystal habits, grain inner structures, shapes or distributions described above, are used in the light-sensitive photographic materials (elements) for various use purposes.

The silver halide grain in the photographic light-sensitive material may have a regular crystal form such as cubic, tetradecahedral or rhombic decahedral form, an irregular crystal form such as spherical or tabular form, or a composite form of these crystal forms. A mixture of grains having various crystal forms may also be used.

In the photographic light-sensitive material of the present invention, the silver halide grain forming the emulsion layer preferably has an aspect ratio of from 3 to 100. The terms "an aspect ratio of from 3 to 100" as used herein means that silver halide grains having an aspect ratio (circle-corresponding diameter of a silver halide grain/thickness of a grain) of from 3 to 100 occupy 50% or more of the projected area of all silver halide grains in the emulsion. The aspect ratio is preferably from 3 to 20, most preferably from 4 to 12. The tabular grain can be easily prepared by the methods described in Gutoff, *Photographic Science and Engineering*, Vol. 14, pp. 248–257 (1970), U.S. Pat. Nos. 4,434,226, 4,414,310, 4,433,048 and 4,439,520 and British Patent 2,112,157.

In the photographic light-sensitive material of the present invention, the existence ratio of such a grain is 70% or more, preferably 85% or more.

The methine compound of the present invention is used in the light-sensitive materials for the uses described later, as a sensitizer, a sensitizing dye or a filter or for the purpose of antihalation or irradiation prevention. The dye may be added to a desired layer such as an interlayer, a protective layer or a back layer other than the light-sensitive emulsion layer.

The methine compound of the present invention may be used in various color or black-and-white silver halide photographic light-sensitive materials.

More specifically, the compound may be used in a color positive light-sensitive material, a light-sensitive material for color paper, a color negative light-sensitive material, a color reversal light-sensitive material (may or may not contain a coupler), a direct positive silver halide photographic light-sensitive material, a photographic light-sensitive material for photomechanical process (for example, lith film, lith dupe film), a light-sensitive material for cathode-ray tube display, a light-sensitive material for X-ray recording (in particular, direct or indirect photographing material using a screen), a light-sensitive material for use in the silver salt diffusion transfer process, a light-sensitive material for use in the color diffusion transfer process, a light-sensitive material for use in the dye transfer process (inhibition process), a light-sensitive material for use in the silver dye bleaching process or a heat developable light-sensitive material.

The silver halide photographic emulsion for use in the present invention may be prepared using the methods described in P. Glafkides, *Chemie et Phisigue Photographigue*, Paul Montel (1967), G. F. Duffin, *Photographic Emulsion Chemistry*, The Focal Press (1966), and V. L. Zelikman et al., *Makinq and Coating Photographic Emulsion*, The Focal Press (1964).

At the formation of silver halide grains, a silver halide solvent such as ammonia, potassium thiocyanate, ammonium thiocyanate, a thioether compound (for example, those described in U.S. Pat. Nos. 3,271,157, 3,574,628, 3,704,130, 4,297,439 and 4,276,374), a thione compound (for example, those described in JP-A-53-144319, JP-A-53-82408 and JP-A-55-77737) and an amine compound (for example, those described in JP-A-54-100717), may be used so as to control the growth of grains.

In the process of formation or physical ripening of silver halide grains, a cadmium salt, a zinc salt, a thallium salt, an iridium salt or a complex salt thereof, a rhodium salt or a complex salt thereof, or an iron salt or an iron complex salt may be present together.

Examples of the internal latent image-type silver halide emulsion for use in the present invention include a conversion type silver halide emulsion, a core/shell type silver halide emulsion and a silver halide emulsion having incorporated therein a different kind of metal, described in U.S. Pat. Nos. 2,592,250, 3,206,313, 3,447,927, 3,761,276 and 3,935,014.

The silver halide emulsion is usually subjected to chemical sensitization. The chemical sensitization may be performed using the method described, for example, in H. Fieser (compiler), *Die Grundlagen der Photographischen Prozese mit Silberhalogeniden*, Akademishe Verlagsgesellschaft, pp. 675–734 (1968).

More specifically, a sulfur sensitization method using a compound containing a sulfur capable of reaction with active gelatin or silver (e.g., thiosulfates, thioureas, mercapto compounds, rhodanines); a selenium sensitization method; a reduction sensitization method using a reducing material (e.g., stannous salt, amines, hydrazine derivatives, formamidinesulfinic acid, silane compounds); and a noble metal sensitization method using a noble metal compound (e.g., gold complex salt, a complex salt of metals belonging to Group VIII of the Periodic Table, such as Pt, Ir and Pd) may be used individually or in combination.

The photographic light-sensitive material of the present invention may contain various compounds so as to prevent fogging or to stabilize photographic capabilities, during production, storage or photographic processing of the light-sensitive material. More specifically, a large number of compounds known as an antifoggant or a stabilizer may be added and examples thereof include azoles such as benzothiazolium salts described in U.S. Pat. Nos. 3,954,478 and 4,942,721 and JP-A-59-191032, an open ring form thereof described in JP-B-59-26731, nitroindazoles, triazoles, benzotriazoles and benzimidazoles (in particular, nitro- or halogen-substitution product); heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole) and mercaptopyrimidines; the above-described heterocyclic mercapto compounds having a water-soluble group such as a carboxyl group or a sulfone group; thioketone compounds such as oxazolinethione; azaindenes such as tetrazaindenes (in particular, 4-hydroxy-substituted (1,3,3a,7) tetrazaindenes); benzenethiosulfonic acids; benzenesulfinic acids; and acetylene compounds described in JP-A-62-87957.

The silver halide photographic light-sensitive material of the present invention may contain a color coupler such as a cyan coupler, a magenta coupler or a yellow coupler, or a compound capable of dispersing the coupler.

More specifically, the silver halide photographic light-sensitive material of the present invention may contain a compound capable of forming a color upon oxidation coupling with an aromatic primary amine developing agent (e.g., phenylenediamine derivative, aminophenol derivative). Examples of the magenta coupler include a 5-pyrazolone coupler, a pyrazolobenzimidazole coupler, a cyanoacetylcoumarone coupler and an open-chained acylacetonitrile coupler. Examples of the yellow coupler include an acylacetamide coupler (e.g., benzoylacetanilides, pivaloylacetanilides). Examples of the cyan coupler include a naphthol coupler and a phenol coupler. These couplers are preferably nondiffusible as having a hydrophobic group called a ballast group within the molecule. The coupler may be either 4-equivalent or 2-equivalent to the silver ion. Further, the coupler may be a colored coupler having a color correction effect or a coupler which releases a development inhibitor accompanying the development (so-called DIR coupler).

Other than the DIR coupler, a non-coloring DIR coupling compound which forms a colorless product upon coupling reaction and releases a development inhibitor, may also be incorporated.

The photographic light-sensitive material of the present invention may contain a polyalkylene oxide or a derivative thereof such as ether, ester or amine, a thioether compound, a thiomorpholine, a quaternary ammonium salt compound, a urethane derivative, a urea derivative, an imidazole derivative or a 3-pyrazolidone, so as to increase the sensitivity, intensify the contrast or accelerate the development.

The silver halide light-sensitive material of the present invention may contain various dyes other than the methine compound of the present invention, as a filter dye or for other various purposes such as prevention of irradiation.

Examples of the dye include oxonol dyes having a pyrazolone nucleus or a barbituric acid nucleus described in British Patents 506,385, 1,177,429, 1,311,884, 1,338,799, 1,385,371, 1,467,214, 1,433,102 and 1,553,516, JP-A-48-85130, JP-A-49-114420, JP-A-52-117123, JP-A-55-161233, JP-A-59-111640, JP-B-39-22069, JP-A-43-13168, JP-A-62-273527, U.S. Pat. Nos. 3,247,127, 3,469,985 and 4,078,9.33, other oxonol dyes described in U.S. Pat. Nos. 2,533,472 and 3,379,533, British Patent 1,278,621, JP-A-1-134447 and JP-A-1-183652, azo dyes described in British Patents 575,691, 680,631, 599,623, 786,907, 907,125 and 1,045,609, U.S. Pat. No. 4,255,326, JP-B-59-211043, azomethine dyes described in JP-A-50-100116, JP-A-54-118247, British Patents 2,014,598 and 750,031, anthraquinone dyes described in U.S. Pat. No. 2,865,752, arylidene dyes described in U.S. Pat. Nos. 2,533,009, 2,688,541 and 2,538,008, British Patents 584,609 and 1,210,252, JP-A-50-40625, JP-A-51-3623, JP-A-51-10927, JP-A-54-118247, JP-B-48-3286 and JP-B-59-37303, styryl dyes described in JP-B-28-3082, JP-B-44-16594 and JP-B-59-28898, triarylmethane dyes described in British Patents 446,583 and 1,335,422, and JP-A-59-228250, merocyanine dyes described in British Patents 1,075,653, 1,153,341, 1,284,730, 1,475,228 and 1,542,807, and cyanine dyes described in U.S. Pat. Nos. 2,843,486 and 3,294,539, and JP-A-1-291247.

These dyes are prevented from diffusion by the method described below.

A method of letting a hydrophilic polymer having a charge reverse to the anionic dye dissociated be present together as a mordant in the layer to localize the dye in a specific layer by the interaction with the dye molecule, is disclosed, for example, in U.S. Pat. Nos. 2,548,564, 4,124,386 and 3,625,694.

A method for dyeing a specific layer using a water-insoluble dye solid is disclosed in JP-A-56-12639, JP-A-55-155350, JP-A-55-155351, JP-A-63-27838, JP-A-63-197943 and European Patent 15,601.

Further, a method for dyeing a specific layer using a metal salt fine particle to which a dye is adsorbed is disclosed in U.S. Pat. Nos. 2,719,088, 2,496,841 and 2,496,843, and JP-A-60-45237.

The photographic material of the present invention may contain various surface active agents as a coating agent or for various purposes such as prevention of electrostatic charge, improvement of slipperiness, emulsion dispersion, prevention of adhesion and improvement of photographic properties (for example, acceleration of development, intensification of contrast, sensitization).

In practicing the present invention, other additives are used together with a silver halide emulsion or other hydrophilic colloid, and examples thereof include a discoloration inhibitor, an inorganic or organic hardening agent, a color fogging inhibitor, an ultraviolet absorbent, a mordant, a plasticizer, a latex polymer and a matting agent. These additives are specifically described in *Research Disclosure*, Vol. 176 (1978, XI), D-17643.

The photographic light-sensitive material of the present invention uses a hydrophilic polymer such as gelatin, as a protective colloid.

The finished silver halide emulsion or the like is coated on an appropriate support such as baryta paper, resin-coated paper, synthetic paper, triacetate film, polyethylene terephthalate, other plastic base or glass plate.

The exposure for obtaining a photographic image may be performed using a usual method. More specifically, any of known various light sources such as natural light (sun light), tungsten light, fluorescent light, mercury light, xenon arc light, carbon arc light, xenon flash light and cathode-ray tube flying spot, may be used. With respect to the exposure time, the exposure time of from $1/1{,}000$ sec to 1 sec used in a usual camera may of course be used, and also the exposure shorter than $1/1{,}000$ sec, for example, the exposure of from $1/10^4$ to $1/10^6$ sec, using a xenon flash light or cathode-ray tube, may be used, or the exposure longer then 1 sec may be used. If desired, the spectral composition of the light used in the exposure may be controlled by a color filter. A laser light may also be used for the exposure. Further, the exposure may be performed by the light emitted from the phosphor excited by an electron beam, X ray, $\gamma$ ray or $\alpha$ ray.

In the photographic processing of the light-sensitive material of the present sent-invention, any of known methods and known processing solutions as described, for example, in *Research Disclosure*, No. 176, pp. 28–30 (RD-17643) may be used. The photographic processing may be either photographic processing of forming a silver image (black-and-white photographic processing) or photographic processing of forming a dye image (color photographic processing). The processing temperature is usually from 18° C. to 50° C., however, a temperature lower than 18° C. or exceeding 50° C. may also be used.

A silver halide photographic light-sensitive material having a magnetic recording layer (hereinafter referred to as a "light-sensitive material"), which may be used in the present invention, is prepared in such a manner that a polyester thin layer support previously subjected to heat treatment, as described in detail in JP-A-6-35118, JP-A-6-17528 and *JIII Journal of Technical Disclosure* No. 94-6023, such as a polyethylene aromatic dicarboxylate-base polyester support, having a thickness of from 50 to 300 $\mu$m, preferably from 50 to 200 $\mu$m, more preferably from 80 to 115 $\mu$m, still more preferably from 85 to 105 $\mu$m, is subjected to heat treatment (annealing) at a temperature of from 40° C. to a glass transition temperature for from 1 to 1,500 hours, the support is then subjected to surface treatment such as ultraviolet irradiation described in JP-B-43-2603, JP-B-43-2604 and JP-B-45-3828 or corona discharging described in JP-B-48-5043 and JP-A-51-131576, undercoating described in U.S. Pat. No. 5,326,689 is applied thereon, a subbing layer described in U.S. Pat. No. 2,761,791 is provided, if desired, and ferromagnetic particles described in JP-A-59-23505, JP-A-4-195726 and JP-A-6-59357 are coated thereon.

The above-described magnetic layer may be coated like a stripe as described in JP-A-4-124642 and JP-A-4-124645.

The support may further be subjected to antistatic treatment as described in JP-A-4-62543. Finally, a silver halide emulsion is coated thereon. The silver halide emulsion used here include those described in JP-A-4-166932, JP-A-3-41436 and JP-A-3-41437.

Such a light-sensitive material is preferably manufactured according to the manufacture control method described in JP-B-4-86817 and the manufacturing data are preferably recorded thereon according to the method described in JP-B-6-87146. After or before the recording, the light-sensitive material is cut into a film smaller in the width than the conventional 135 size film and two perforations are formed at one side per one small-format picture so as to match the small format picture reduced in the size than the conventional one, according to the method described in JP-A-4-125560.

The thus-prepared film is loaded before use in a cartridge package described in JP-A-4-157459, a cartridge described in JP-A-5-210202, FIG. 9, a film patrone described in U.S. Pat. No. 4,221,479 or a cartridge described in U.S. Pat. Nos. 4,834,306, 4,834,366, 5,226,613 and 4,846,418.

The film cartridge or film patrone used herein is preferably of such a type that the tongue can be housed as described in U.S. Pat. Nos. 4,848,693 and 5,317,355 in view of the light-shielding property.

A cartridge having a lock mechanism described in U.S. Pat. No. 5,296,886, a cartridge capable of indicating the use state described in U.S. Pat. No. 5,347,334 or a cartridge having a double exposure preventive function is preferably used.

Further, a cartridge where the film can be easily loaded by merely inserting the film into the cartridge described in JP-A-6-85128 may also be used.

The thus-produced film cartridge may be used for photographing and development to satisfy the object or for various photographic enjoyments using a camera, a developing machine or a lab. machine which will be described below.

The film cartridge (patrone) can exert its function sufficiently when, for example, a camera in a simple loading system described in JP-A-6-8886 and JP-A-6-99908, a camera having an automatic winding-up system described in JP-A-6-57398 and JP-A-6-101135, a camera where the film can be taken out and the kind of film can be exchanged on the way of photographing described in JP-A-6-205690, a camera where the photographing information such as panorama photographing, high-vision photographing or normal photographing (capable of magnetic recording where the print aspect ratio can be selected) can be magnetic recorded on the film described in JP-A-5-293138 and JP-A-5-283382, a camera having a double exposure preventive function described in JP-A-6-101194 or a camera having a function to indicate the use state, for example, of the film described JP-A-5-150577, is used.

Thus photographed film may be processed in an automatic developing machine described in JP-A-6-222514 and JP-A-6-222545 and before, during or after the processing, the method of using the magnetic recording on the film described in JP-A-6-95265 and JP-A-4-123054 may be used or the aspect ratio selection function described in JP-A-5-19364 may be used.

In developing the film, if it is a cine-type development, the film is spliced according to the method described in JP-A-5-119461 before the processing.

During or after the development, the film may be subjected to attaching/detaching treatment described in JP-A-6-148805.

After the processing as above, the film information may be converted into a print through back printing or front printing on a color paper according to the. method described in JP-A-2-184835, JP-A-4-186335 and JP-A-6-79968.

Further, the film may be returned to the user together with the index print and the cartridge for return described in JP-A-5-11353 and JP-A-5-232594.

The present invention is described below in greater detail with reference to examples, but the present invention should not be construed as being limited to these examples.

EXAMPLE 1

Synthesis Example of Compound (2):

Compound (2) was synthesized through the route of the following scheme 1:

Scheme 1:

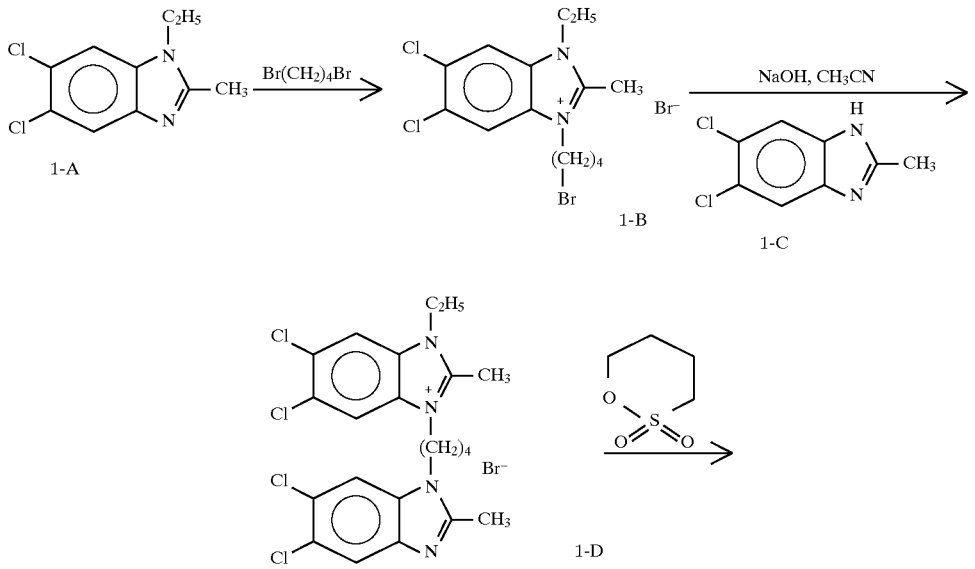

-continued

Scheme 1:

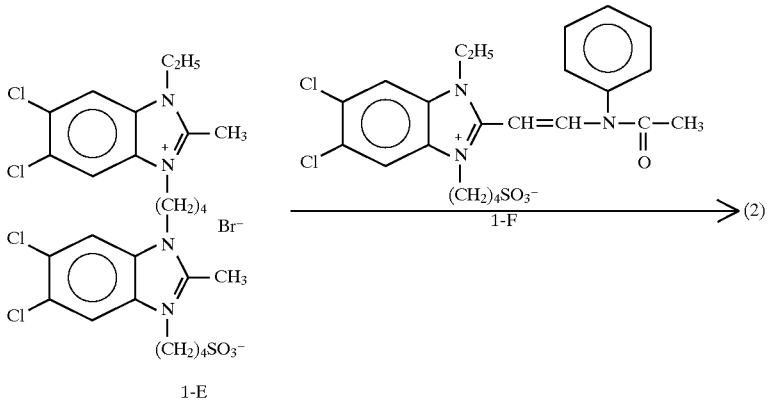

15 g of 5,6-dichloro-2-methyl-1-ethylbenzimidazole (1-A) and 70 g of 1,4-dibromobutane were mixed and stirred at an outer temperature of 100° C. for 12 hours. The crystals precipitated were filtered, washed with acetonitrile and dissolved in 200 ml of a 5% hydrous acetonitrile by heating, and the resulting solution was concentration-recrystallized under normal pressure and then dried under reduced pressure to obtain 20 g (yield: 69%) of white crystal 1-B.

6.6 g of 1-B and 3.0 g of 5,6-dichloro-2-methylbenzimidazole (1-C) were added to an aqueous solution containing 0.6 g of sodium hydroxide while stirring in acetonirile. After stirring at room temperature for 15 hours, ethyl acetate was added thereto and the mixture was further stirred for 1 hour. The crystals filtered and taken out were dissolved in methanol-acetonitrile by heating and the resulting solution was concentrated under normal pressure and allowed to stand for several hours to precipitate crystals. The crystals were collected by filtration, washed with methanol and then dried under normal pressure to obtain 3.36 g (yield: 40%) of white crystal (1-D). 3.0 g of 1-D and 6 ml of butanesultone were mixed and stirred at an outer temperature of 150° C. for 7 hours. Thereafter, 100 ml of ethyl acetate was added thereto and the mixture was stirred at room temperature for from 1 to 2 hours, decanted and then dried under reduced pressure to obtain highly viscous oily product (1-E).

1.05 g of 1-F was added to 1.0 g of 1-E and dissolved in 10 ml of dimethylsulfoxide. Thereto, 1.4 ml of 1,8-diazabicyclo[5,4,0]-7-undecene and 0.36 ml of acetic anhydride were added, and the mixture was stirred at room temperature for 1 hour. 50 ml of methanol was added and after further stirring for 30 minutes, the crystals precipitated were collected by filtration, washed with methanol and dissolved in methanol-chloroform by heating. The resulting solution was concentrated under normal pressure and allowed to stand for several hours to precipitate crystals. The crystals precipitated were collected by filtration, washed with methanol and then dried under reduced pressure to obtain 380 mg (yield: 22%) of orange crystal (2). Absorption maximum (methanol): 487.3 nm ($\epsilon$=2.01×10$^5$). Melting point: 265°–271°C.

EXAMPLE 2

Synthesis of Compound (19):

Compound (19) was synthesized through the route of the following scheme 2.

Scheme 2:

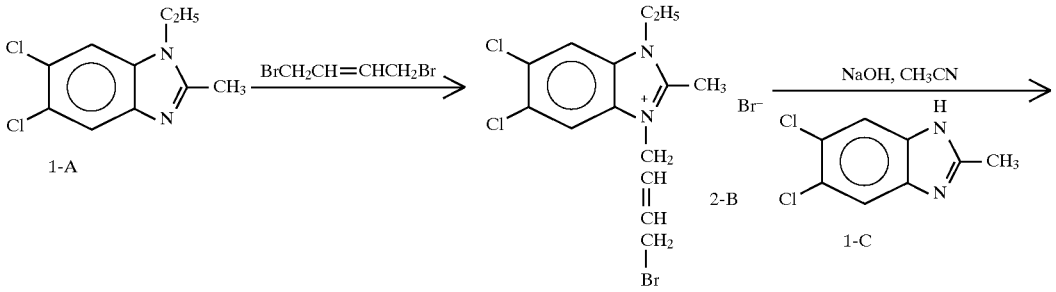

-continued

Scheme 2:

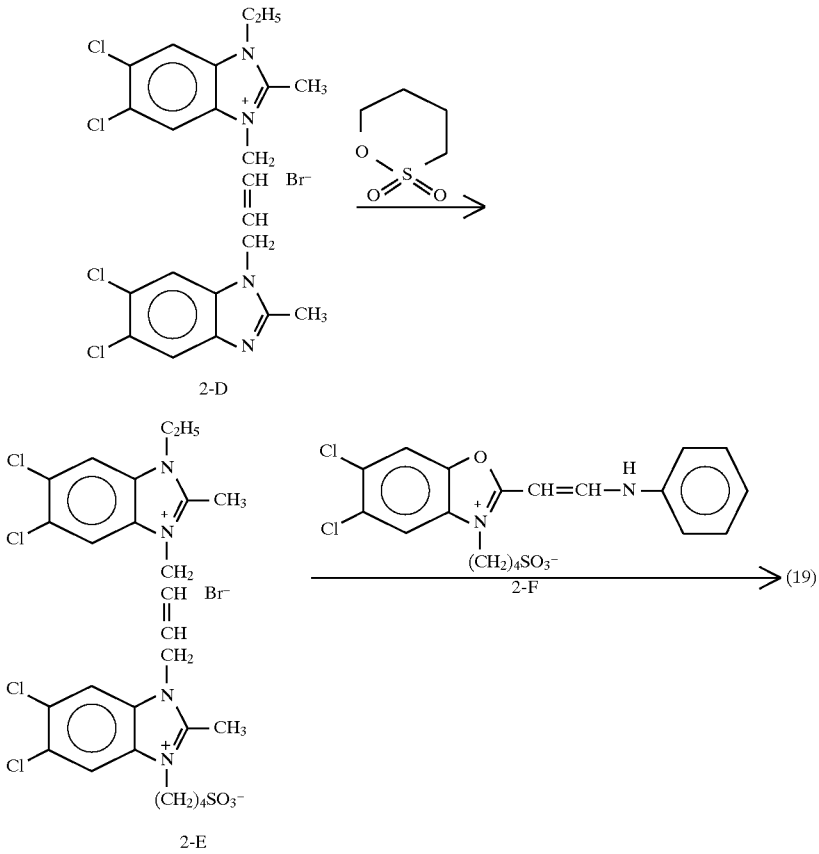

7.2 g of 5,6-dichoro-2-methyl-1-ethylbenzimidazole (1-A) and 10 g of 1,4-dibromo-2-butene were mixed and stirred at room temperature for 15 hours. The crystals precipitated were filtered, washed with acetonitrile and dissolved in 200 ml of a 5% hydrous acetonitrile by heating, and the resulting solution was concentration-recrystallized under normal pressure and then dried under reduced pressure to obtain 11.8 g (yield: 85%) of white crystal 2-B.

1.33 g of 2-B and 0.60 g of 5,6-dichloro-2-methylbenzimidazole (1-C) were added to an aqueous solution containing 0.12 g of sodium hydroxide while stirring in acetonirile. After stirring at room temperature for 15 hours, ethyl acetate was added thereto and the mixture was further stirred for 1 hour. The crystals filtered and taken out were dissolved in a 5% hydrous acetonirile by heating and the resulting solution was concentrated under normal pressure and allowed to stand for several hours to precipitate crystals. The crystals were collected by filtration, washed with methanol and then dried under normal pressure to obtain 480 mg (yield: 28%) of white crystal (2-D).

3.0 g of 2-D and 6 ml of butanesultone were mixed and stirred at an outer temperature of 150° C. for 11 hours. Thereafter, 150 ml of ethyl acetate was added thereto and the mixture was stirred at room temperature for 2 hours, decanted and then dried under reduced pressure to obtain 2.41 g (yield: 66%) of highly viscous oily product (2-E).

6.9 ml of acetic anhydride was added to 2.87 g of 2-F and stirred at an outer temperature of 100° C. for 15 hours and thereto, 20 ml of dimethylformamide, 2.87 g of 2-E and 9 ml of triethylamine were added and stirred at an outer temperature of 100° C. for 20 minutes. Thereto, 100 ml of ethyl acetate was added and stirred for 1 hours. The crystals precipitated were collected by filtration and recrystallized from methanol to obtain 1.0 g (yield: 11%) of orange crystal (19). Absorption maximum (methanol): 461.3 nm ($\epsilon$=1.6×$10^5$). Melting point: 256°–266° C.

EXAMPLE 3

(1) Preparation of Emulsion

To an aqueous solution (containing 1,200 ml of water, 7.0 g of gelatin and 4.5 g of KBr) containing gelatin having an average molecular weight of 15,000 kept at 30° C. and under stirring, an aqueous 1.9M $AgNO_3$ solution and an aqueous 1.9M KBr solution were added by a double jet method each at a rate of 25 ml/min over 70 seconds to obtain nuclei of tabular grains. To 400 ml of this emulsion as seed crystals, 650 ml of an aqueous inactive gelatin solution (containing 20 g of gelatin and 1.2 g of KBr) was added, and the emulsion was ripened by raising the temperature to 75° C. for 40 minutes. Then, an aqueous $AgNO_3$ solution (containing 1.7 g of $AgNO_3$) was added over 1 minute and 30 seconds, subsequently, 7.0 ml of an aqueous $NH_4NO_3$ (50 wt. %) solution and 7.0 ml of $NH_3$ (25 wt. %) were added, and the emulsion was further ripened for 40 minutes.

The emulsion was adjusted to have a pH of 7 by $HNO_3$ (3N) and after adding 1.0 g of KBr thereto, while keeping the pAg at 7.9, 366.5 ml of an aqueous 1.9M $AgNO_3$ solution and an aqueous KBr solution were added, subsequently, 53.6 ml of an aqueous 1.9M $AgNO_3$ solution and an aqueous KBr (containing 33.3 mol % of KI) solution were added, and then 160.5 ml of an aqueous 1.9M $AgNO_3$ solution and an aqueous KBr solution were added to obtain Emulsion 1.

Emulsion 1 obtained was a triple structure grain where the intermediate shell had a region highest in the silver iodide content, and had an average aspect ratio of 2.8, an occupation ratio of tabular grains having an aspect ratio of 3 or more in the entire projected area of 26%, a coefficient of variation of the grain size of 7% and an average grain size, in terms of the sphere-corresponding diameter, of 0.98 $\mu$m.

Emulsion 1 was desalted by a usual flocculation method and after adding a sensitizing dye per mol of silver, subjected to optimal gold, sulfur and selenium sensitization in the presence of the dye.

(2) Preparation of Coated Sample

On a triacetyl cellulose film support having provided thereon an undercoat layer, an emulsion layer and a protective layer shown in Table 1 were coated to prepare Samples 101 to 112.

TABLE 1

| | | |
|---|---|---|
| (1) | Emulsion layer | |
| | Emulsion: Emulsion 1 (the dye used is shown in Table 2) (as silver: 2.1 × $10^{-2}$ mol/$m^2$) Coupler (1.5 × $10^{-3}$ mol/$m^2$) | |
| | 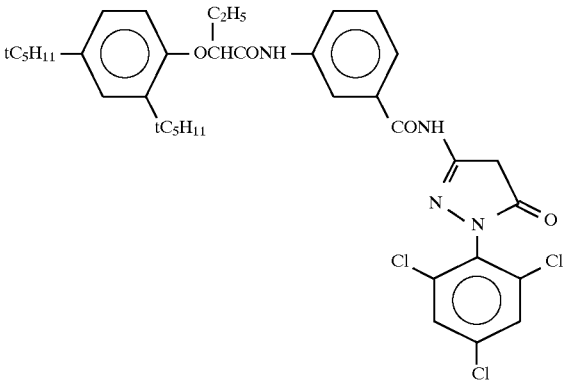 | |
| | Tricresyl phosphate | (1.10 g/$m^2$) |
| | Gelatin | (2.30 g/$m^2$) |
| (2) | Protective layer | |
| | 2,4-Dichloro-6-hydroxy-s-triazine sodium salt | (0.08 g/$m^2$) |
| | Gelatin | (1.80 g/$m^2$) |

The coated samples prepared were determined on the absorption spectrum using a spectrophotometer with an integrating sphere, U-3410, manufactured by Hitachi Ltd. The value S was obtained by integrating the absorption strength at the longer wavelength side than 350 nm to the abscissa (eV). The results obtained are-shown in Table 2.

These samples each was subjected to exposure (1/100 second) for sensitometry and then color developed through the following steps.

Processing Method:

| Step | Processing Time | Processing Temperature (°C.) | Replenishing Amount* (ml) | Tank Volume (l) |
|---|---|---|---|---|
| Color development | 2 min 45 sec | 38 | 33 | 20 |
| Bleaching | 6 min 30 sec | 38 | 25 | 40 |
| Water washing | 2 min 10 sec | 24 | 1,200 | 20 |
| Fixing | 4 min 20 sec | 38 | 25 | 30 |

-continued

| Step | Processing Time | Processing Temperature (°C.) | Replenishing Amount* (ml) | Tank Volume (l) |
|---|---|---|---|---|
| Water washing (1) | 1 min 05 sec | 24 | countercurrent piping system from (2) to (1) | 10 |
| Water washing (2) | 1 min 00 sec | 24 | 1,200 | 10 |
| Stabilization | 1 min 05 sec | 38 | 25 | 10 |
| Drying | 4 min 20 sec | 55 | | |

* Replenishing amount was per 1 m of the light-sensitive material in width of 35 mm.

The composition of each processing solution is shown below.

| | Mother Solution (g) | Replenisher (g) |
|---|---|---|
| (Color Developer) | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-Ethy-N-β-hydroxy-ethylamino]-2-aniline sulfate | 4.5 | 5.5 |
| Water to make | 1.0 l | 1.0 l |
| pH | 10.05 | 10.05 |
| (Bleaching Solution) | | |
| Sodium ethylenediaminetetra-acetato ferrate trihydrate | 100.0 | 120.0 |
| Disodium ethylenediamine-tetraacetate | 10.0 | 11.0 |
| Ammonium bromide | 140.0 | 160.0 |
| Ammonium nitrate | 30.0 | 35.0 |
| Aqueous ammonia (27%) | 6.5 ml | 4.0 ml |
| Water to make | 1.0 l | 1.0 l |
| pH | 6.0 | 5.7 |
| (Fixing Solution) | | |
| Sodium ethylenediaminetetra-acetate | 0.5 | 0.7 |
| Sodium sulfite | 7.0 | 8.0 |
| Sodium bisulfite | 5.0 | 5.5 |
| Aqueous ammonium thiosulfate solution (70%) | 170.0 ml | 200.0 ml |
| Water to make | 1.0 l | 1.0 l |
| pH | 6.7 | 6.6 |
| (Stabilizing Solution) | | |
| Formalin (37%) | 2.0 ml | 3.0 ml |
| Polyoxyethylene-p-monononyl-phenyl ether (polymerization degree: 10) | 0.3 | 0.45 |
| Disodium ethylenediamine-tetraacetate | 0.05 | 0.08 |
| Water to make | 1.0 l | 1.0 l |
| pH | 5.8–8.0 | 5.8–8.0 |

The processed samples each was determined on the density through a green filter.

The sensitivity is defined as the reciprocal of the exposure amount necessary for giving a density 0.2 higher then the fog density, and the sensitivity of each sample is shown by a relative value to the sensitivity of Sample 101, taken as 100. The kind of emulsions and methine compounds used in each sample and the results obtained on determination of the sensitivity of samples are shown in Table 2.

TABLE 2

| Sample No. | Methine Compound | Addition Amount (mol/Ag-mol) | S | Sensitivity | Remarks |
|---|---|---|---|---|---|
| 101 | Compound 1 | $4.0 \times 10^{-4}$ | 1.00 (control) | 100 (control) | Comparison |
| 102 | " | $8.0 \times 10^{-4}$ | 1.05 | 103 | " |
| 103 | (2) | $4.0 \times 10^{-4}$ | 1.93 | 190 | Invention |
| 104 | (3) | " | 1.81 | 180 | " |
| 105 | (6) | " | 1.79 | 178 " | |
| 106 | (39) | " | 2.09 | 205 | " |
| 107 | Compound 2 | $4.0 \times 10^{-4}$ | 0.98 | 97 | Comparison |
| 108 | " | $8.0 \times 10^{-4}$ | 1.02 | 100 | " |
| 109 | Compound 3 | $4.0 \times 10^{-4}$ | 1.25 | 123 | " |
| 110 | (13) | " | 1.79 | 175 | Invention |
| 111 | (15) | " | 1.78 | 175 | " |
| 112 | (19) | " | 1.64 | 158 | " |

Compound 1

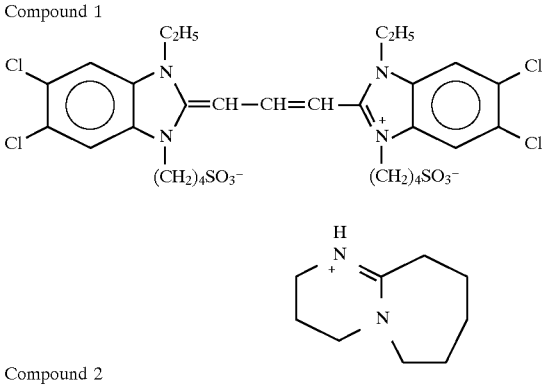

Compound 2

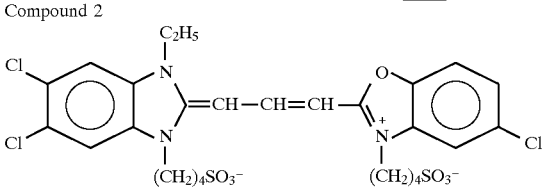

Compound 3

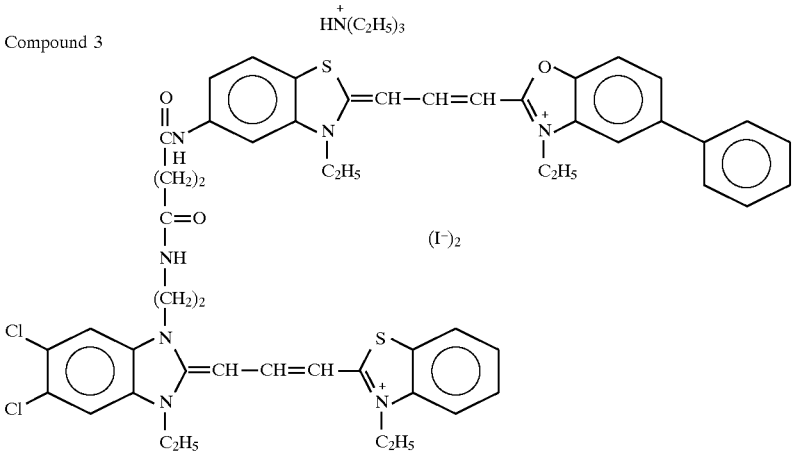

It is seen from Table 2 that the samples of the present invention are highly sensitive and have a large percent of light absorption in the silver halide emulsion.

EXAMPLE 4

(Preparation of Emulsion 2)

To an aqueous solution (containing 1,200 ml of water, 7.0 g of gelatin and 4.5 g of KBr) containing gelatin having an average molecular weight of 15,000 kept at 30° C. and under stirring, an aqueous 1.9M $AgNO_3$ solution and an aqueous 1.9M KBr solution were added by a double jet method each at a rate of 25 ml/min over 70 seconds to obtain nuclei of tabular grains. To 350 ml of this emulsion as seed crystals, 650 ml of an aqueous inactive gelatin solution (containing 20 g of gelatin and 1.2 g of KBr) was added, and the emulsion was ripened by raising the temperature to 75° C. for 40 minutes. Then, an aqueous $AgNO_3$ solution (containing 1.7 g of $AgNO_3$) was added over 1 minute and 30 seconds, subsequently, 6.2 ml of an aqueous $NH_4NO_3$ (50 wt %) solution and 6.2 ml of $NH_3$ (25 wt %) were added, and the emulsion was further ripened for 40 minutes.

The emulsion was adjusted to have a pH of 7 by $HNO_3$ (3N) and after adding 1.0 g of KBr thereto, while keeping the pAg at 8.3, 366.5 ml of an aqueous 1.9M $AgNO_3$ solution and an aqueous KBr solution were added , subsequently, 53.6 ml of an aqueous 1.9M $AgNO_3$ solution and an aqueous KBr (containing 33.3 mol % of KI) solution were added, and then 160.5 ml of an aqueous 1.9M $AgNO_3$ solution and an aqueous KBr solution were added to obtain Emulsion 2.

Emulsion 2 obtained was a triple structure grain where the intermediate shell had a region highest in the silver iodide content, and had an average aspect ratio of 6.7, an occupation ratio of tabular grains having an aspect ratio of 6 or more in the entire projected area of 80%, an occupation ratio of tabular grains having an aspect ratio of from 3 to 100 in the entire projected area of about 95%, a coefficient of variation of the grain size of 11% and an average grain size, in terms of the sphere-corresponding diameter, of 1.00 $\mu$m.

Emulsion 2 was desalted by a usual flocculation method and after adding $5.4\times10^{-4}$ mol/mol-Ag (corresponding to 80% of saturation coverage) of a sensitizing dye, subjected to optimal gold, sulfur and selenium sensitization in the presence of the dye.

(2) Preparation of Coated Sample

On a triacetyl cellulose film support having provided thereon an undercoat layer, the same emulsion layer and protective layer as in Example 1 were coated using Emulsion 2 to prepare Samples 201 to 212.

These samples were determined on the integration value S from the absorption spectrum in the same manner as in Example 1. Further, these samples each was subjected to exposure (1/100 second) for sensitometry and then to the color development and determination of the density in the same manner as in Example 1. The kind of emulsions and methine compounds used in each sample, and the results obtained on determination of the S value and the sensitivity of samples are shown in Table 3. The sensitivity of each sample is shown by a relative value to the sensitivity of Sample 201, taken as 100.

TABLE 3

| Sample No. | Methine Compound | Addition Amount (mol/Ag-mol) | S | Sensitivity | Remarks |
|---|---|---|---|---|---|
| 201 | Compound 1 | $4.0\times10^{-4}$ | 1.00 (control) | 100 (control) | Comparison |
| 202 | " | $8.0\times10^{-4}$ | 1.10 | 108 | " |
| 203 | (2) | $4.0\times10^{-4}$ | 2.0 | 198 | Invention |
| 204 | (3) | " | 2.05 | 205 | " |
| 205 | (6) | " | 2.13 | 210 | " |
| 206 | (39) | " | 1.8 | 180 | " |
| 207 | Compound 2 | $4.0\times10^{-4}$ | 1.01 | 101 | Comparison |
| 208 | " | $8.0\times10^{-4}$ | 1.07 | 105 | " |
| 209 | Compound 3 | $4.0\times10^{-4}$ | 1.26 | 124 | " |
| 210 | (13) | " | 1.95 | 193 | Invention |
| 211 | (15) | " | 1.89 | 185 | " |
| 212 | (19) | " | 1.80 | 179 | " |

It is seen from Table 3 that the samples of the present invention, as comprising an emulsion having an aspect ratio of 3 or more, are more highly sensitive and have a large percent of light absorption.

EXAMPLE 5

Emulsions 3 to 16 and Samples 301 to 320 were prepared according to the method described below, and the results obtained on determination of the sensitivity are shown in Table 4.

Emulsion 3:

Tabular silver iodobromide was prepared in the same manner as Emulsion D in Example 5 of JP-A-8-29904 and designated as Emulsion 3. Multi-layer color light-sensitive materials were prepared in the same manner as Sample 101 in Example 5 of JP-A-8-29904 except for replacing Emulsion H in the ninth layer of Sample 101 in Example 5 of JP-A-8-29904 by Emulsion 3 and replacing ExS-4, ExS-5 and ExS-6 by Compound 1 or Sensitizing Dye (2) of the present invention, and the samples obtained were designated as Sample. 301 and Sample 302.

In order to examine the sensitivity, the thus-obtained samples each was exposed to light of Fuji Model FW Sensitometry (manufactured by Fuji Photo Film Co., Ltd.) through an optical wedge and a green filter for 1/100 second, color developed using the processing steps and the processing solutions in Example 1 of JP-A-8-29904, and determined on the magenta density. The sensitivity is shown by a relative value taking the sensitivity of Sample 301 as 100 after obtaining a reciprocal of the exposure amount necessary for giving a density of (fog density) +0.2.

Emulsions 4 to 7:

Tetradecahedral silver iodobromide emulsions were prepared in the same manner as Emulsion 1 in Example 1 of JP-A-7-92601 except for replacing the spectral sensitizing dye by Compound 1 or Sensitizing Dye (2) of the present invention, and the emulsions prepared were designated as Emulsion 4 and Emulsion 5. Further, cubic silver iodobromide emulsions were prepared in the same manner as Emulsion 1 in Example 1 of JP-A-7-92601 except for changing the silver potential during the second double jet addition from +65 mV to +115 mV and replacing the spectral sensitizing dye by Compound 1 or Sensitizing Dye (2) of the present invention, and the emulsions prepared were designated as Emulsion 6 and Emulsion 7.

Multi-layer color light-sensitive materials were prepared in the same manner as Sample 401 in Example 4 of JP-A-7-92601 except for replacing Emulsion 1 in the ninth layer of Sample 401 in Example 4 of JP-A-7-92601 by Emulsion 4 or Emulsion 5, and the samples obtained were designated as Sample 303 and Sample 304. In the same manner, Samples 305 and 306 were prepared by replacing Emulsion 1 in the ninth layer of Sample 401 in Example 4 of JP-A-7-92601 by Emulsion 6 or Emulsion 7.

The thus-obtained samples were evaluated on the sensitivity. These samples each was subjected to 1/50 second exposure, color reversal development and determination of magenta density, in the same manner as in Example 4 of JP-A-7-92601. The sensitivity is shown by a relative value taking the sensitivity of Sample 303 as 100 after obtaining a reciprocal of the exposure amount necessary for giving a density of (a minimum density obtained upon sufficient exposure) +0.2.

Emulsions 8 and 9:

An octahedral silver bromide internal latent image-type directive positive emulsion and a hexagonal tabular silver bromide internal latent image-type direct positive emulsion were prepared in the same manner as Emulsion 1 and Emulsion 5 in Example 1 of JP-A-5-313297, respectively, the emulsion prepared were designated as Emulsion 8 and Emulsion 9.

Color diffusion transfer photographic films were prepared in the same manner as Sample 101 in Example 1 of JP-A-5-313297 except for replacing Emulsion 2 and Sensitizing Dye (2) in the eleventh layer of Sample 101 in Example 1 of JP-A-5-313297 by Emulsion 8 and Compound 1 or Sensitizing Dye (2) of the present invention, respectively, and the samples obtained were designated as Sample 307 and Sample 308. In the same manner, Samples 309 and 310 were prepared by replacing Emulsion 2 and Sensitizing Dye (2) in the eleventh layer of Sample 101 in Example 1 of JP-A-5-313297 by Emulsion 9 and Compound 1 or Sensitizing dye (2) of the present invention, respectively. In order to examine the sensitivity, the thus-obtained samples each was processed using the same processing steps and processing solutions as in Example 1 of JP-A-5-313297, and determined on the transfer density using a color densitometer. The sensitivity is shown by a relative value taking the sensitivity of Sample 303 as 100 after obtaining a reciprocal of the exposure amount necessary for giving a density of 1.0.

Emulsions 10 and 11:

Silver chlorobromide emulsions were prepared in the same manner as Emulsion F in Example 2 of JP-A-4-142536 except for not adding Red-Sensitive Sensitizing Agent (S-1) before sulfur sensitization, using chloroauric acid in combination to effect optimal gold-sulfur sensitization in addition to sulfur sensitization of triethylthiourea, and adding Compound 1 or Sensitizing Dye (2) of the present invention after gold-sulfur sensitization, and the emulsions prepared were designated as Emulsion 10 and Emulsion 11.

Multi-layer color printing papers were prepared in the same manner as Sample 20 in Example 1 of JP-A-6-347944 except for replacing the emulsion in the third layer of Sample 20 in Example 1 of JP-A-6-347944 by Emulsion 10 or Emulsion 11, and the samples obtained were designated as Sample 311 and Sample 312.

In order to examine the sensitivity, the thus-obtained samples each was exposed to light of Fuji Model FW Sensitometry (manufactured by Fuji Photo Film Co., Ltd.) through an optical wedge and a green filter for 1/100 second, color developed using the processing steps and the processing solutions described in Example 1 of JP-A-6-347944, and determined on the magenta density. The sensitivity is shown by a relative value taking the sensitivity of Sample 311 as 100 after obtaining a reciprocal of the exposure amount necessary for giving a density of fog density +0.2.

Emulsions 12 and 13:

Tabular silver chloride emulsions were prepared in the same manner as Emulsion A in Example 1 of JP-A-8-122954 except that the chemical sensitization was performed using Compound 1 or Sensitizing Dye (2) of the present invention in place of Sensitizing Dyes 1 and 2 in Chemical Sensitization (B) in Example 1 of JP-A-8-122954, and the emulsions prepared were designated as Emulsion 12 and Emulsion 13.

Coated Samples 313 and 314 were prepared by coating an emulsion layer and a surface protective layer in combination by the co-extrusion method on the both surfaces of a support in the same manner as in Example 1 of JP-A-8-122954 except for replacing the emulsion in Example 1 of JP-A-8-122954 by Emulsion 12 or Emulsion 13. The coated silver amount per one surface was 1.75 g/m$^2$.

In order to examine the sensitivity, the thus-obtained samples each was subjected to exposure from both sides for 0.05 second using an X-ray orth screen HGM manufactured by Fuji Photo Film Co., Ltd., and then processed using the same automatic developing machine and processing solutions as used in Example 1 of JP-A-8-122954. The sensitivity is indicated by a logarithm of the reciprocal of the exposure amount necessary for giving a density of (fog density) +0.1 and shown by a relative value to the sensitivity of Sample 313, taken as 100.

Emulsion 14:

A tabular silver chloride emulsion was prepared in the same manner as Emulsion D in Example 2 of Japanese Patent Application No. 7-146891 (corresponding to JP-A-8-227117) except for not adding Sensitizing Dyes 2 and 3, and the emulsion prepared was designated as Emulsion 14.

Coated samples were prepared in the same manner as Coated Sample F in Example 3 of Japanese Patent Application No. 7-146891 except for replacing Emulsion F and Sensitizing Dye 1 of Coated Sample F in Example 3 of Japanese Patent Application No. 7-146891 by Emulsion 14 and Compound 1 or Sensitizing dye (2) of the present invention, respectively, and the samples obtained were designated as Sample 315 and Sample 316.

In order to examine the sensitivity, the thus-obtained samples each was exposed to light of Fuji Model FW Sensitometry (manufactured by Fuji Photo Film Co., Ltd.) through an optical wedge and a green filter for 1/100 second, subjected to Fuji Photo Film CN16 processing, and determined on the magenta density. The sensitivity is indicated by a logarithm of the reciprocal of the exposure amount necessary for giving a density of (fog density) +0.2 and shown by a relative value to the sensitivity of Sample 315, taken as 100.

Emulsion 15:

A octahedral silver chloride emulsion was prepared in the same manner as Emulsion F in Example 3 of Japanese Patent Application No. 7-146891 and the emulsion prepared was designated as Emulsion 15.

Coated samples were prepared in the same manner as Coated Sample F in Example 3 of Japanese Patent Application No. 7-146891 except for replacing Emulsion F and Sensitizing Dye 1 of Coated Sample F in Example 3 of Japanese Patent Application No. 7-146891 by Emulsion 15 and Compound 1 or Sensitizing Dye (2) of the present invention, respectively, and the samples obtained were designated as Sample 317 and Sample 318.

In order to examine the sensitivity, the thus-obtained samples each was exposed to light of Fuji Model FW Sensitometry (manufactured by Fuji Photo Film Co., Ltd.) through an optical wedge and a green filter for 1/100 second, subjected to Fuji Photo Film CN16 processing, and determined on the magenta density. The sensitivity is indicated by a logarithm of the reciprocal of the exposure amount necessary for giving a density of (fog density) +0.2 and shown by a relative value to the sensitivity of Sample 317, taken as 100.

Emulsion 16:

A tabular emulsion was prepared in the same manner as Emulsion CC of European Patent 0699950 and the emulsion prepared was designated as Emulsion 16. Coated samples were prepared in the same manner as in the Example of European Patent 0699950 except for performing chemical sensitization by adding Compound 1 or Sensitizing Dye (2) of the present invention in place of Dyes 1 and 2, and the samples obtained were designated as Sample 319 and Sample 320. The samples were exposed and developed in the same manner as in European Patent 0699950 and the sensitivities were compared. The sensitivity is indicated by a logarithm of the reciprocal of the exposure amount necessary for giving a density of fog +0.2 and shown by a relative value to the sensitivity of Sample 319, taken as 100.

TABLE 4

| Sample No. | Sensitizing Dye | Addition Amount (mol/mol-Ag) | Sensitivity | Remarks |
|---|---|---|---|---|
| 301 | Compound 1 | $1.4 \times 10^{-3}$ | 100 (control) | Comparison |
| 302 | (2) | $7.0 \times 10^{-4}$ | 179 | Invention |
| 303 | Compound 1 | $3.6 \times 10^{-3}$ | 100 (control) | Comparison |
| 304 | (2) | $1.8 \times 10^{-3}$ | 198 | Invention |
| 305 | Compound 1 | $4.0 \times 10^{-3}$ | 105 | Comparison |
| 306 | (2) | $2.0 \times 10^{-3}$ | 205 | Invention |
| 307 | Compound 1 | $8.0 \times 10^{-3}$ | 100 (control) | Comparison |
| 308 | (2) | $4.0 \times 10^{-3}$ | 168 | Invention |
| 309 | Compound 1 | $1.2 \times 10^{-2}$ | 98 | Comparison |
| 310 | (2) | $6.0 \times 10^{-3}$ | 165 | Invention |
| 311 | Compound 1 | $2.4 \times 10^{-4}$ | 100 (control) | Comparison |
| 312 | (2) | $1.2 \times 10^{-4}$ | 188 | Invention |
| 313 | Compound 1 | $2.4 \times 10^{-3}$ | 100 (control) | Comparison |
| 314 | (2) | $1.2 \times 10^{-3}$ | 185 | Invention |
| 315 | Compound 1 | $2.4 \times 10^{-3}$ | 100 (control) | Comparison |
| 316 | (2) | $1.2 \times 10^{-3}$ | 198 | Invention |
| 317 | Compound 1 | $2.0 \times 10^{-3}$ | 100 (control) | Comparison |
| 318 | (2) | $1.0 \times 10^{-3}$ | 209 | Invention |
| 319 | Compound 1 | $4.0 \times 10^{-3}$ | 100 (control) | Comparison |
| 320 | (2) | $2.0 \times 10^{-3}$ | 190 | Invention |

It is seen from Table 4 that samples of the present invention can achieve high sensitivity with various emulsions.

In the case of Samples 313 and 314, even when exposure was performed using HR-4 or HGH in place of the X-ray orth screen HGM used at the exposure time, similar results can be obtained.

According to the present invention a highly sensitive silver halide photographic light-sensitive material having a high percent of light absorption can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a light-sensitive silver halide emulsion layer and at least one methine compound represented by the following formula (I):

(I)

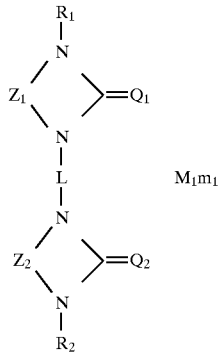

$M_1m_1$ wherein $R_1$ and $R_2$ each represents an alkyl group, provided that at least one of $R_1$ and $R_2$ represents an alkyl group substituted by a dissociative group; $Z_1$ and $Z_2$ are the same or different, and each represents an atomic group necessary for forming a 5- or 6-membered nitrogen-containing heterocyclic ring; L represents a divalent linking group; $M_1$ represents a charge equilibration counter ion; $m_1$ represents a number of from 0 to 10 necessary for neutralizing the electric charge of the molecule; and $Q_1$ and $Q_2$ are the same or different, and each represents a methine group or a polymethine group necessary for forming a methine dye.

2. A silver halide photographic light-sensitive material as claimed in claim 1, wherein the methine compound represented by formula (I) is a methine compound represented by the following formula (II):

(II)

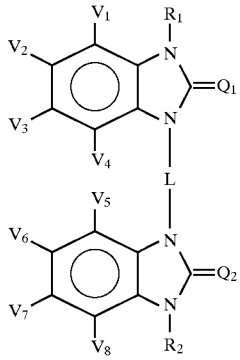

$M_1m_1$ wherein $V_1$, $V_2$, $V_3$, $V_4$, $V_5$, $V_6$, $V_7$ and $V_8$ each represents a hydrogen atom or a substituent, and L, $R_1$, $R_2$, $Q_1$, $Q_2$, $M_1$ and $m_1$ have the same meanings as defined in formula (I).

3. A silver halide photographic light-sensitive material as claimed in claim 1, wherein the at least one methine compound represented by formula (I) is contained in an amount of $1\times10^{-6}$ to $8\times10^{-3}$ mol per mol of silver halide.

4. A silver halide photographic light-sensitive material comprising at least one methine compound represented by the following formula (III):

(III)

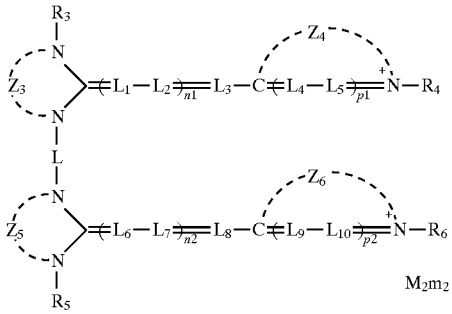

$M_2m_2$ wherein $L_1$, $L_2$, $L_3$, $L_4$, $L_5$, $L_6$, $L_7$, $L_8$, $L_9$ and $L_{10}$ each represents a methine group; $P_1$ and $P_2$ each represents 0 or 1; $n_1$ and $n_2$ each represents 0, 1, 2 or 3; $Z_3$, $Z_4$, $Z_5$ and $Z_6$ each represents an atomic group necessary for forming a 5- or 6-membered nitrogen-containing heterocyclic ring; $M_2$ represents a charge equilibration counter ion; $m_2$ represents a number of from 0 to 4 necessary for neutralizing the electric charge of the molecule; and $R_3$, $R_4$, $R_5$ and $R_6$ each represents an alkyl group, provided at least one of R4 and $R_6$ represents an alkyl group substituted by a dissociative group.

5. A silver halide photographic light-sensitive material as claimed in claim 4, wherein the at least one methine compound represented by formula (III) is contained in an amount of $1\times10^{-6}$ to $8\times10^{-3}$ mol per mol of silver halide.

* * * * *